US010856619B2

(12) United States Patent
Fuerst, Sr.

(10) Patent No.: US 10,856,619 B2
(45) Date of Patent: Dec. 8, 2020

(54) ARTICLE OF FOOTWEAR HAVING KNIT UPPER WITH EDGING

(71) Applicant: Fuerst Group, Inc., Menlo Park, CA (US)

(72) Inventor: Rory Fuerst, Sr., Atherton, CA (US)

(73) Assignee: FUERST GROUP, INC., Menlo Park, CA (US)

( * ) Notice: Subject to any disclaimer, the term of this patent is extended or adjusted under 35 U.S.C. 154(b) by 507 days.

(21) Appl. No.: 15/912,502

(22) Filed: Mar. 5, 2018

(65) Prior Publication Data

US 2018/0249787 A1 Sep. 6, 2018

Related U.S. Application Data

(60) Provisional application No. 62/467,765, filed on Mar. 6, 2017.

(51) Int. Cl.
*A43B 1/04* (2006.01)
*A43C 1/06* (2006.01)
(Continued)

(52) U.S. Cl.
CPC ..... *A43C 1/06* (2013.01); *A43B 1/04* (2013.01); *A43B 3/12* (2013.01); *A43B 11/00* (2013.01);
(Continued)

(58) Field of Classification Search
CPC ..... A43B 1/04; A43B 11/00; A43B 23/0205; A43B 23/0235; A43B 23/0245; A43B 3/12; A43B 3/126
(Continued)

(56) References Cited

U.S. PATENT DOCUMENTS 5,651,195 A * 7/1997 Clancy ..... A43B 3/12 36/11.5
5,991,950 A * 11/1999 Schenkel ..... A43B 3/122 12/142 T
(Continued)

FOREIGN PATENT DOCUMENTS

CN 202819807 U 3/2013
WO 2015181928 A1 12/2015

OTHER PUBLICATIONS

ISA Korean Intellectual Property Office, International Search Report and Written Opinion Issued in Application No. PCT/US2018/020981, dated Sep. 3, 2018, WIPO, 12 pages.
(Continued)

*Primary Examiner* — Marie D Bays
(74) *Attorney, Agent, or Firm* — McCoy Russell LLP

(57) ABSTRACT

A footwear article, comprising a single-piece knit upper that includes a medial portion and a plurality straps. The footwear article may further comprise one or more openings formed into the knit upper, a perimeter of the one or more openings defined at least in part by an edge of the knit upper, and a pipe edging may be fixed to the edge of the knit upper defining the openings. Further, a sole may be coupled to the knit upper. In at least one example, the footwear article may additionally comprise a lacing system that includes a plurality of cords, and strap of the knit upper may have a separate cord section of the lacing system attached therein. A plastic overlay may be positioned over the cords of the lacing system that are attached to the knit upper, in at least one example.

20 Claims, 10 Drawing Sheets

(51) Int. Cl.

| | |
|---|---|
| ***A43B 11/00*** | (2006.01) |
| ***A43C 7/00*** | (2006.01) |
| ***A43B 23/02*** | (2006.01) |
| ***A43B 13/41*** | (2006.01) |
| ***A43C 11/00*** | (2006.01) |
| ***A43C 1/00*** | (2006.01) |
| ***A43B 3/12*** | (2006.01) |

(52) U.S. Cl.
CPC ..... *A43B 13/41* (2013.01); *A43B 23/0205* (2013.01); *A43B 23/0235* (2013.01); *A43B 23/0245* (2013.01); *A43B 23/0265* (2013.01); *A43C 1/003* (2013.01); *A43C 7/00* (2013.01); *A43C 11/00* (2013.01)

(58) Field of Classification Search
USPC ..... 36/50.1, 11.5
See application file for complete search history.

(56) References Cited

U.S. PATENT DOCUMENTS 7,234,251 B2 6/2007 Fuerst et al.
8,533,976 B2 9/2013 Fuerst
8,745,895 B2 6/2014 Sokolowski et al.
8,819,962 B2 * 9/2014 Candella ..... A43B 17/00 36/43
2003/0182820 A1 * 10/2003 Fuerst ..... B29D 35/0081 36/11.5
2004/0261290 A1 * 12/2004 Wilson ..... A43B 17/18 36/11.5
2008/0052960 A1 * 3/2008 Belley ..... A43B 13/16 36/50.1
2008/0289214 A1 * 11/2008 Aveni ..... A43B 3/103 36/11.5
2009/0126229 A1 * 5/2009 Fuerst ..... B29D 35/0081 36/88
2010/0037483 A1 * 2/2010 Meschter ..... A43B 23/0235 36/47
2012/0198730 A1 8/2012 Burch et al.
2014/0068968 A1 3/2014 Podhajny et al.
2014/0130372 A1 5/2014 Aveni et al.
2014/0196311 A1 * 7/2014 Follet ..... B32B 5/06 36/45
2014/0338226 A1 * 11/2014 Zavala ..... A43B 23/0205 36/84
2015/0047225 A1 * 2/2015 Zavala ..... A43C 11/006 36/84
2015/0059209 A1 * 3/2015 Dekovic ..... A43B 23/042 36/84
2018/0343973 A1 * 12/2018 Hancock ..... A43B 23/045
2019/0307209 A1 * 10/2019 Houng ..... A43C 1/06

OTHER PUBLICATIONS

Allen, R., "Adidas Originals Sets Release Date for NMD Camo Pack," Available Online at http://footwearnews.com/2016/focus/athletic-outdoor/adidas-nmd-r1-primeknit-camo-pack-sneakers-release-date-may-12-220272/, May 10, 2016, 6 pages.

* cited by examiner

ARTICLE OF FOOTWEAR HAVING KNIT UPPER WITH EDGING

CROSS REFERENCE TO RELATED APPLICATIONS

The present application claims priority to U.S. Provisional Application No. 62/467,765, entitled "ARTICLE OF FOOTWEAR HAVING KNIT UPPER WITH EDGING", and filed on Mar. 6, 2017. The entire contents of the above-listed application are hereby incorporated by reference for all purposes.

BACKGROUND/SUMMARY

Articles of footwear that include knit uppers may be beneficial for improving a fit and comfort of the article of footwear for a user. For example, the flexibility of knit uppers may be beneficial for improving a fit and comfort of the footwear article. However, footwear articles comprising knit uppers may present several challenges.

For example, while the flexibility of knit uppers may be beneficial for a fit and comfort of an article of footwear, this flexibility lacks structure that may be desired for certain portions of a footwear article. Specifically, the flexibility of knit materials being used for an upper may create issues in regards to structuring openings that may be formed in a knit upper, such as openings formed into the knit upper between straps of the knit upper. Additionally, the flexibility of knit uppers may not provide sufficient lateral support for a footwear article, such as lateral support at ankle regions of the footwear article.

Furthermore, knit uppers may be more susceptible to degradation compared to other materials, such as leather, for example. In particular, the frequent stretching and relaxing of knit uppers may cause edges of knit fabric uppers to be prone to degradation. Additionally, in at least one example, a footwear article comprising a knit upper may include lacing system components, such as cords, that may be positioned over the knit upper. However, in at least one embodiment, the footwear article may not include a lacing system and may instead rely upon the knit upper to hold the footwear article on a user's foot.

The inventors have recognized these drawbacks with footwear articles comprising knit uppers. Therefore, to at least partially address the above issues, the inventors herein have taken alternative approaches to footwear construction. In one example, the inventors have developed an article of footwear comprising a knitted upper with straps formed of unitary construction with a medial portion of the knit upper and including openings between the straps. The straps may be lined with edge piping, and the straps may be overlaid with a material, such as a plastic material, in order to provide a desired integrity while maintaining the flexibility, comfort, feel, and visual appeal of the knitted fabric. The overlay plastic material may be thermoplastic polyurethane (TPU), in at least one example. However, other materials such as polyurethane (PU) may also be used for the overlay material. Additionally, in at least one example, the overlays may be clear to enable viewing of a cord structure and the knit upper. The overlays may be coupled to the knit upper via any one or more of gluing, sewing, or direct molding of the overlays onto the knit upper, for example.

By lining the straps of the footwear article with edge piping, degradation of the edges may be reduced and a shape of the footwear article may be better maintained. For example, the edge piping may help to prevent distortion of a shape and size of the openings formed into the upper by providing structure to the openings.

Further, the inclusion of an overlays, such as TPU, laid over the straps may help to increase the rigidity of the straps so that a shape of the straps is maintained while still providing the comfort and fit advantages of the knit upper. Specifically, as the plastic overlay material is laid over the straps, the knit upper is still in direct contact with a foot of a user wearing the footwear article, thus maintaining a shape of the straps while still providing the fit and comfort benefits of the knit material.

Additionally, in at least one example the footwear article may include a lacing system comprising cord sections, and at least some of these cord sections may be positioned between overlays of the footwear article and the knit upper. These overlays may be cord fixing overlays provided over the cord sections to trap the cords between the overlays and the knit upper, for example.

The lacing system cord structure may be positioned on top of the knit upper to enable further adjustment of a fit of the footwear article and may include an interlocking loop system to attach cord sections to one another. For example, the lacing system may include cords that wrap around a heel strap and an ankle of the footwear article.

It is noted that reference to a loop herein refers to an arc shape formed by the cords of the lacing system cord structure, where either end of the arc shape is not free (e.g., trapped against the knit upper). For example, an arc shape (loop) may be formed by a bend in a portion of a cord section that is not trapped against a knit upper of the footwear article. For example, a loop may be formed by trapping almost an entire length of a cord section against a knit upper of the footwear article, and the remaining portion of the cord section that is not trapped against the knit upper is an end of the cord section that is bent to form an arc shape (loop), with both ends of the arc shape held against the knit upper.

Further, the inclusion of the overlays over at least some of the cords of the lacing system may provide additional strength for holding the cords against the footwear article and to provide additional support to the ankle and heel strap portion of the footwear article. The overlays provided over the cord sections may serve the purposes of holding the cord structure sections in place and dispersing a force applied to the knit upper due to pulling of the cord section, for example. Thus, the cord structure sections may be more strongly held against the knit upper due to the positioning of the cord sections between the overlay and the knit upper, and a dispersion of forces applied to the knit upper due to pulling on the cord sections may prevent a ripping of the knit upper. Furthermore, the overlay may have the added benefit of providing additional support to regions of the knit upper. Thus, the cords may be held on top of the knit upper via the overlays without having to directly glue the cords to the knit upper.

BRIEF DESCRIPTION OF THE FIGURES

FIGS. 1-6 and 9-10 are shown drawn approximately to scale. However, other relative dimensions may be used if desired.

DETAILED DESCRIPTION

Figure 1:
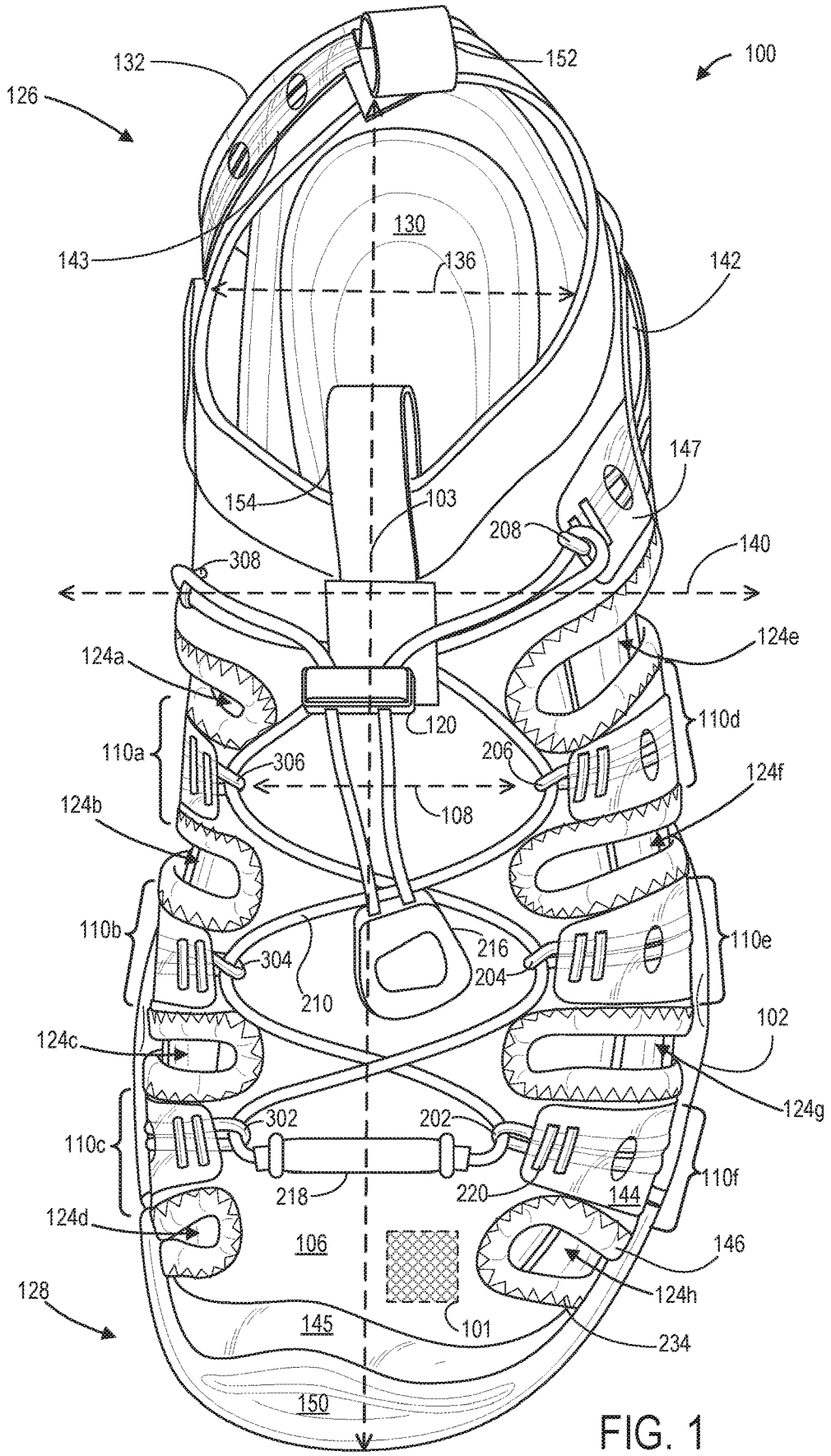
FIG. 1 show a top view of an example footwear article according to at least one example of the present disclosure.

A footwear article is described herein comprising a knit upper with openings formed therein, and structural elements such as edge piping and plastic overlays. Example footwear articles that may include such features are shown at FIGS. 1-10. The knit upper of the footwear article may be formed as a single piece and may include a medial portion and one or more straps extending in a transverse direction from the medial portion of the knit upper. One or more openings may be formed into the knit upper, and edge piping may be provided on edges of the knit upper defining a perimeter of the openings formed into the knit upper. Providing edge piping on the edges of the knit upper forming the perimeter of the openings may prevent degradation of the edges of the knit upper while also providing structure for the openings, for example.

Additionally or alternatively, the footwear article may include a lacing system comprising a cord structure. However, in other examples, the footwear article may not include a cord structure, and the footwear article may simply be pulled onto a user's foot, instead of having a lacing system for further tightening an upper of the footwear article onto the user's foot. Further, in at least on example, the footwear article may include an overlay, such as a plastic overlay to provide structure to portions of the knit upper. Additionally, in examples where the footwear article may include a lacing system, the overlay may be used to secure components of a lacing system to the knit upper, where the lacing system may comprise a cord structure including cord sections.

In at least one embodiment, a lateral ankle overlay may be attached to the knit upper to increase an amount of lateral ankle support provided by the footwear article. In another example, an overlay may be fixed over a top of a cord section that is attached to a knit upper to help hold the cord section in place on the knit upper. Additionally, providing an overlay on top of a cord section on the knit upper may disperse forces that may be applied to the knit upper from pulling on the cord section to prevent ripping of the knit upper. Thus, the inclusion of an overlay may serve to both provide additional structure and to function as a force dispersion tool to protect the knit material from damage.

Other features may be included to ensure a proper fit and comfort of the footwear article including the knit upper. For example, a removable footbed may allow the footbed of the footwear article to be selected based on user comfort preferences.

Further, FIGS. 1-10 show the relative positioning of various components. If shown directly contacting each other, or directly coupled, then such components may be referred to as directly contacting or directly coupled, respectively, at least in one example. Similarly, components shown contiguous or adjacent to one another may be contiguous or adjacent to each other, respectively, at least in one example. As an example, components lying in face-sharing contact with each other may be referred to as in face-sharing contact or physically contacting one another. As another example, elements positioned apart from each other with only a space there-between and no other components may be referred to as such, in at least one example.

As yet another example, elements shown above/below one another, at opposite sides to one another, or to the left/right of one another may be referred to as such, relative to one another. Further, as shown in the figures, a topmost element or point of element may be referred to as a "top" of the component and a bottommost element or point of the element may be referred to as a "bottom" of the component, in at least one example. Such relative positioning terms of "top", "bottom", etc. may refer to a footwear article in an upright position, where the sole is below the upper unless indicated otherwise. As used herein, top/bottom, upper/lower, above/below, may be relative to a vertical axis of the figures and used to describe positioning of elements of the figures relative to one another. As such, elements shown above other elements are positioned vertically above the other elements, in one example. As yet another example, shapes of the elements depicted within the figures may be referred to as having those shapes (e.g., such as being circular, straight, planar, curved, rounded, chamfered, angled, or the like). Further, elements shown intersecting one another may be referred to as intersecting elements or intersecting one another, in at least one example. Further still, an element shown within another element or shown outside of another element may be referred as such, in one example. It is further noted that while the example footwear articles in the figures herein show a left footwear article for a left foot of a user, these left footwear articles are understood to also demonstrate features of an example corresponding right footwear article for a right foot of a user. Such example right footwear articles are mirrors of the example left footwear articles shown and share a chiral relationship to the example left footwear articles shown. These right footwear articles have any one or combination of the features of the example left footwear articles described herein.

For purposes of discussion, FIGS. 1-10 will be described collectively.

FIG. 1 shows a first example footwear article 100 comprising an upper 106. The upper 106 may comprise a knit material, as indicated by 101. Though knit material indicator block 101 is not included in the remaining figures, it is noted that the uppers in the remaining figures may also comprise a knit material. The footwear article 100 may include a sole 102. The sole 102 may include an insole/midsole, in one example. Thus, the insole and midsole may be single component in the footwear article. However, in other examples, the insole and midsole may be separate components in the footwear article. The footwear article 100 may further comprise a footbed 130, where the footbed is positioned within an interior cavity formed between an interior surface of the upper 106 and the sole 102 of the footwear article 100.

In at least one example, the insole/midsole 102 and footbed 130 of the footwear article may be made with EVA to improve a comfort of the footwear article. In examples where the insole and midsole may be configured as separate components, the insole may be made of PU while the midsole may be made of a different material, such as TPU for example. Further, materials such as polyvinyl chloride (PVC) may additionally or alternatively be used when constructing the insole/midsole 102 of the footwear article. The insole/midsole 102 may extend over a top of toe region 128 of the footwear article to form a toe bumper 150. The toe bumper 150 may provide additional protection for a foot of a user, for example. Furthermore, the toe bumper 150 may provide water resistance benefits.

The sole 102 may be attached to an upper 106, and the upper 106 may comprise a knit material. The upper 106 may form a top of the footwear article, and the sole 102 may form a bottom of the footwear article, where the upper 106 and the sole 102 oppose one another. Thus, the upper 106 may also be referred to herein as a knit upper. The knit upper 106 may be attached to the sole 102 via any one or combination of sewing, gluing, sonic welding, and other manners for attachment.

In at least one example, the knit upper 106 may include a body 108 and a plurality of transverse portions 110*a*, 110*b*, 110*c*, 110*d*, 110*e*, 110*f*, the transverse portions 110*a*, 110*b*, 110*c*, 110*d*, 110*e*, 110*f*, also referred to herein as straps, extending from the body 108 of the knit upper 106. These straps 110*a*, 110*b*, 110*c*, 110*d*, 110*e*, 110*f* extending from a body 108 of the upper 106 may form a single, unitary piece with the body of the upper. In at least one example, the straps 110*a*, 110*b*, 110*c*, 110*d*, 110*e*, 110*f* may be symmetrical about a longitudinal axis 103 of the footwear article 100. The straps may be substantially parallel to one another.

An overlay, may additionally or alternatively be included on a knit upper 106 of the footwear article at any one or combination of locations including a lateral ankle region of the footwear article, a heel strap 132 of the footwear article, and a toe region 128 of the footwear article. In examples where the overlay may be included over knit upper 106 at a toe region 128 of the footwear article, the overlay may provide wear resistance and may provide some structure to the knit upper 106. The overlay may be positioned on top of the knit upper 106 of a footwear article, and the overlay may be attached to the footwear article via any one or combination of gluing, sewing, directly molding the clear material overlay to the knit upper, sonic welding, and any other fastening device.

For example, footwear article 100 may comprise one or more strap overlays 144 that are a material different than the knit upper and that may overlay the one or more straps 110*a*, 110*b*, 110*c*, 110*d*, 110*e*, 110*f* of the knit upper 106 in at least one example. For example, one or more of the straps 110 of the knit upper 106 may include a plastic strap overlay 144 coupled to an exterior surface of the knit upper 106.

In at least one embodiment, one or more overlays of the footwear article may be made of TPU and may provide reinforcement for the knit upper 106 at regions where the overlay is included. Alternatively, the overlay may be made of PU or another material including properties to provide a desired amount of structural support. Use of the TPU or PU may provide form and structural support to one or more of the heel strap 132, straps 110, a toe region 128, and an ankle region 126 of the footwear article, for example. Additionally or alternatively, a material of the overlay may be integrated with the knit material of the knit upper 106. For example, in at least one embodiment TPU may be woven into the knit material of the knit upper during manufacturing, such as the strap portions of the knit upper 106. Other materials mentioned above that may be used for the overlay, such as PU may also be woven into the knit material of the knit upper 106 during manufacturing.

Further, in at least one example, one or more overlays may be provided on the knit upper to seal at least a portion of the knit upper. For example, the one or more overlays may be used to reduce one or more of particles and water from penetrating the footwear article. Additionally or alternatively, the knit material of the knit upper may have a water resistant coating applied thereon to improve water resistance of the knit upper. The one or more overlays may be positioned on an exterior surface of the knit upper 106 at various regions of the footwear article 100. For example, the one or more overlays may be positioned on any one or combination of over the straps 110, over a toe region 128, over heel strap 132, and on an ankle region 126 of footwear article 100. Thus, the footwear article may include one or more of strap overlays 144, heel strap overlay 143, toe overlay 145, top ankle overlays 147, and lateral ankle overlay 142. Use of toe overlay 145 may be particularly advantageous to provide sealing from water and organic matter from penetrating the knit upper 106, as the toe of the footwear article may be exposed to more water and organic matter during use.

A thickness of the overlay may be a same thickness at each location where the knit upper overlay is included, or the thickness of the overlay may be different at different locations where it may be included. Additionally or alternatively, a thickness of an overlay may be varied within a particular overlay section. For example, as discussed in more detail in FIG. 2, a thickness of a lateral ankle overlay 142 may be varied, as opposed to the lateral ankle overlay 142 being a uniform thickness. Varying a thickness of an overlay may be beneficial to provide a specific support structure for the footwear article, for example.

However, in other examples, each overlay section may have a uniform thickness. Such uniform thickness for an overlay section may be useful for simplifying production of the overlays, for example.

Furthermore, in at least one example, a material used for an overlay may be different at different locations of the footwear article. For example, a material used for a toe overlay 145 may be different than a material used for a heel strap overlay 143. These different materials used for the different overlays may be selected based on one or more of tensile strength, flexibility, and other properties in order to ensure that the materials selected for a specific location on a shoe are providing a desired support and function for that location. However, in other examples, a material used for an overlay may be the same at every location on the footwear article, which may be helpful for simplifying manufacturing.

As a thickness of the overlay is increased, the rigidity of the overlay is increased. Thus, portions of the upper including thicker overlays, may have more structural support compared to portions of the upper that may include thinner overlays. Thus, in at least one example, a thickness of the overlay may be greater in regions of the knit upper 106 where more support may be desired compared to regions where less support may be required. For example, a thickness of a material for a lateral ankle overlay 142 and a heel strap overlay 143, may be thicker compared to a strap overlay 144 and a toe overlay 145.

This is not least because more support may be desirable at an ankle portion and a heel portion of the footwear article than at the straps and the toe of the footwear article. Additionally, if the overlay material, such as TPU, is too thin, it may not provide the necessary support. Additionally or alternatively, top ankle overlay 147 may be included which extends from the lateral ankle overly 142 towards a center of the footwear article. The top ankle overlay 147 may have a similar or a same thickness as the strap overlays 144, in at least one example.

It is noted that the body 108 of the knit upper 106 may be a medial portion of the knit upper 106 in at least one example. Thus, the body 108 of the knit upper 106 may also be referred to herein as a medial portion of the knit upper. For example, the body 108 and the straps 110 of the knit upper 106 may be a single continuous piece without additional fastening treatments and fastening devices to connect the straps 110 or heel strap 132 of the knit upper 106 to the body 108 of the knit upper 106.

Forming the knit upper 106 as a single unitary piece, including a body 108 and straps 110, may be advantageous for simplifying a process of forming the knit upper 106, as the straps 110 may not require additional fastening treatments or devices to attach the straps 110 to the body 108 of the knit upper 106, for example. Additionally, by forming the knit upper 106 as one piece, where straps 110 are integrated with the body 108 of the knit upper 106 may improve a strength of the knit upper 106 compared to other approaches which may include fastening straps to a medial portion of the upper via one or more of stitching, gluing, sonic welding, and other fastening devices or methods. However, in some examples the straps 110 may be fastened to a body 108 of the knit upper 106.

The knit upper 106 may be formed to stretch in a transverse direction 140 of the footwear article. In some examples, all of the knit upper 106 may be formed to stretch in a transverse direction 140 of the footwear article. However, in other examples the knit upper 106 may stretch in a transverse direction 140 in some regions of the upper and may stretch in a different directions in other regions of the upper. Forming the knit upper 106 so that it stretches in a transverse direction 140 of the footwear article, or, in other words, so that a direction of stretch for the knitted upper is across a width of the footwear article, may allow the footwear article to fit a foot of a user better because it may provide more stretch, imparting a glove-like or sock-like fit. In contrast, configuring the direction of stretch of the knit material of the upper from heel to toe may provide less stretch than a knit upper that stretches in the transverse direction 140.

Transverse openings 124, which comprise 124*a*, 124*b*, 124*c*, 124*d*, 124*e*, 124*f*, 124*g*, 124*h*, may be formed in any one or plurality of locations of the upper 106. For example, transverse openings 124 may be formed at any one or combination of locations along a length of a footwear article including between each pair of straps 110, between straps 110 and an ankle region 126 of the upper 106, and between straps 110 and a toe region 128 of the upper 106. Further, in at least one example, the footwear article may include one or more openings formed into the knit upper that may be proximal to an outsole of an of the footwear article.

Figure 2:
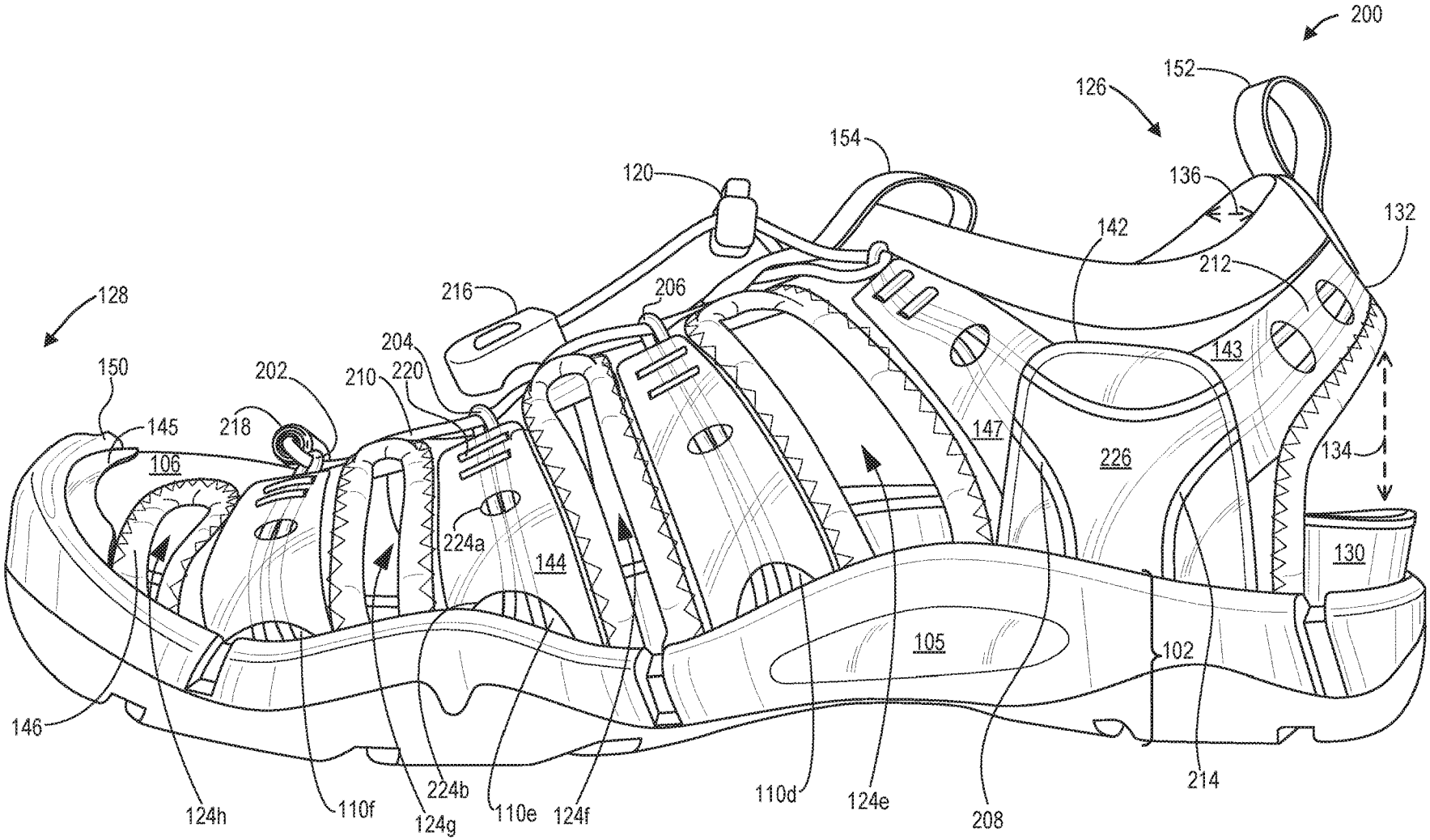
FIG. 2 shows a first side view of the example footwear article according to at least one example of the present disclosure.
Figure 3:
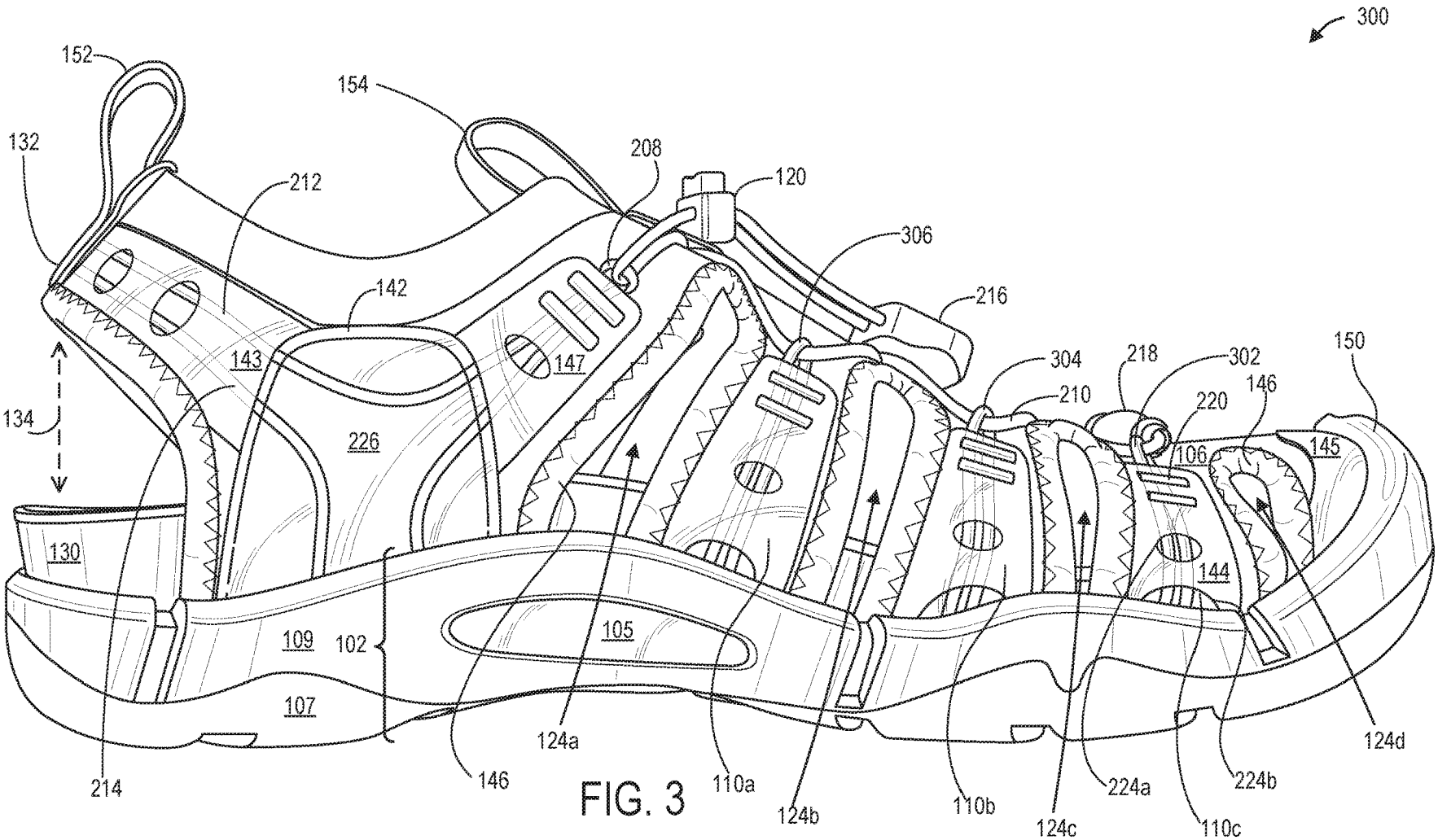
FIG. 3 shows a second side view of the example footwear article according to at least one example of the present disclosure.
Figure 5:
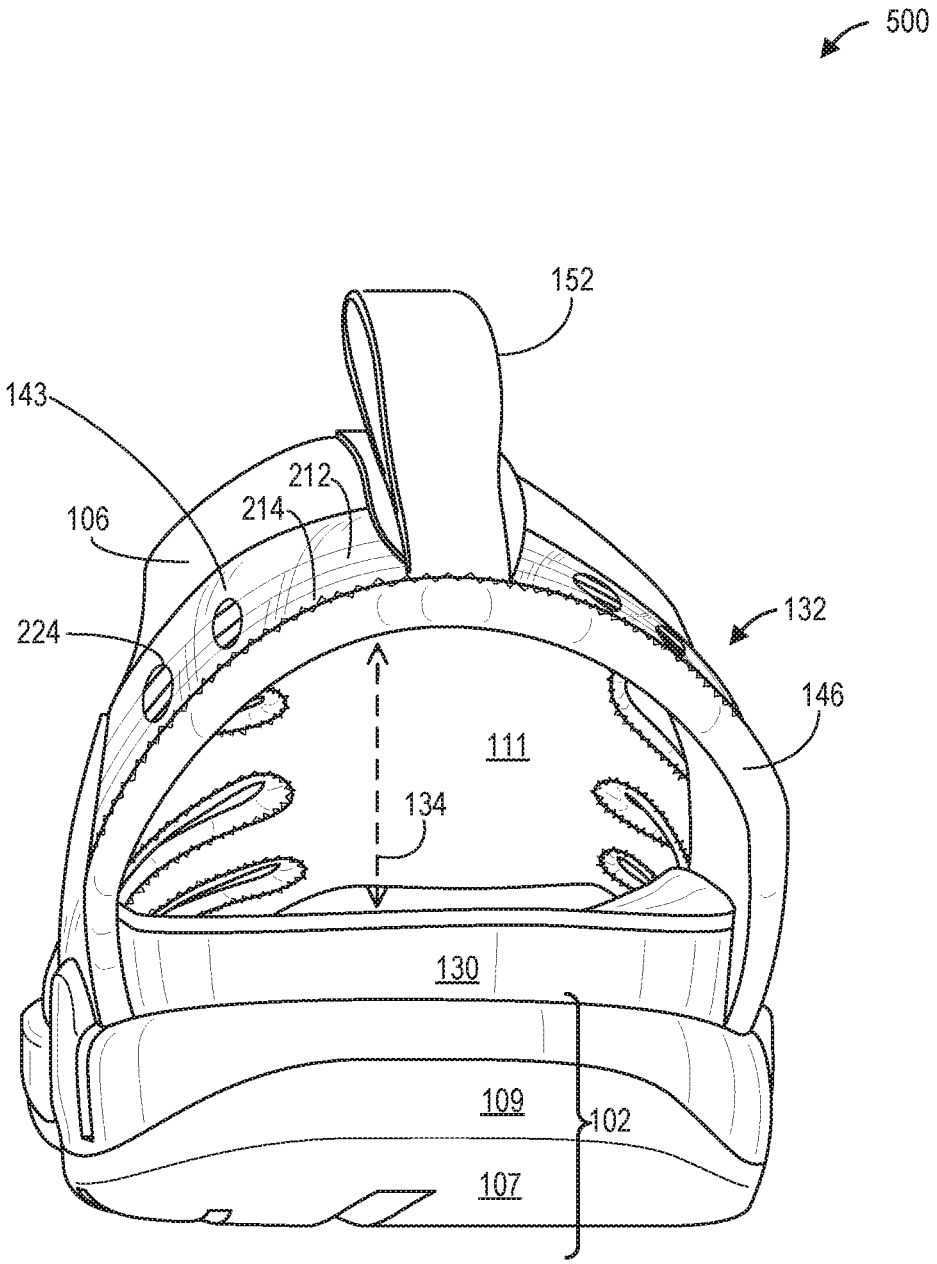
FIG. 5 shows a rear view of the example footwear article according to at least one example of the present disclosure.

Additionally, a heel opening 134, shown at FIGS. 2-3 and at FIGS. 5-6, for example, may be formed between a heel strap 132 and a footbed 130 of a footwear article, and an ankle opening 136 may be formed between the knit upper 106 and the footbed 130 of the footwear article. In at least one example, portion of the knit upper 106 defining the ankle opening 136 may include a ribbed edging surrounding a portion of the ankle opening 136 that fits around an ankle of a user when a foot of a user is positioned in the footwear article. It is further noted that an opening is formed between the entire knit upper 106 and a base of the footwear article, including the footbed 130, where a user's foot may be positioned between the knit upper 106 and the footbed 130 of the footwear article to hold the footwear article on a foot of the user.

A front of the footwear article may be a toe region 128 of the footwear article and an ankle region 126 of the footwear article may be a rearward region of the footwear article, with a heel of the footwear article forming the back of the footwear article. The toe region 128 and the ankle region 126 may be at opposite ends of the footwear article, where the heel of the footwear article is at a complete opposite end of the footwear article compared to the toe of the footwear article.

Transverse openings 124 formed in the upper 106 may serve several purposes. For example, forming transverse openings 124 in the upper 106 may be beneficial for venting a footwear article thus improving user comfort, and forming transverse openings 124 in an upper 106 of a footwear article, such as a knit upper 106, may help to reduce an amount of material required to form the upper 106, thus reducing a cost of materials to manufacture the footwear article.

Additionally or alternatively, transverse openings 124 formed in an upper 106 of a footwear article may improve a movement of the footwear article. For example, in addition to the material of the knit upper having flexible properties, a footwear article may include transverse openings 124 in the knit upper 106 along a length of the footwear article that may enable the footwear article to provide even more flexing of the upper 106 during use of the footwear article compared to footwear articles that may not include such transverse openings. Furthermore, in some examples, forming openings in an upper of a footwear article may reduce an overall weight of the footwear article, resulting in improved user comfort for walking long distances, for example.

In at least one example, transverse openings 124 may be formed along both sides of a footwear article, where a medial portion 108 of the upper 106 of the footwear article is positioned between the transverse openings 124 formed in each side of the footwear article. However, in at least one embodiment, the transverse openings 124 may only be formed along a single side of the footwear article. Further, in at least one embodiment, the transverse openings 124 may be formed in a footwear article that may not include an upper 106 with a medial portion 108. For example, the transverse openings 124 may extend across an entire upper or the transverse openings 124 may extend to a portion of the upper 106 that is not a medial portion.

Further, transverse openings 124 formed in the upper 106 may be formed with specific shapes, such as elongated shapes, in order to provide better movement of the footwear article with a user's foot. For example, the transverse openings 124 of a footwear article may be formed with elongated shapes along a longitudinal direction of the footwear article, where a length of the transverse openings 124 are parallel to a transverse direction 140 of the knit upper 106 in order to enable the knit upper 106 to better flex with a movement of a user. By locating transverse openings 124 with an elongated shape along a length of the footwear article in upper 106, a footwear article may better flex with a user's foot while a user may be walking, for example.

Furthermore, a particular size of an opening 124 formed into the knit upper 106 of the footwear article may provide benefits. For example, a size of openings 124*d*, 124*h* in the knit upper 106 of the footwear article that are proximal a toe region 128 of the footwear article may be formed with a smaller size than a remainder of the openings 124 to prevent toes of a user from slipping through the transverse openings 124*d*, 124h formed in the knit upper 106. Moreover, in at least one example, a shaping of openings 124*d*, 124*h* may differ from the remaining openings 124 formed into the knit upper 106.

For example, though not shown, the openings 124*d*, 124*h* may be teardrop shaped so that a portion of openings 124*d*, 124*h* immediately adjacent the sole 102 of the footwear article 100 is closed. Such a shaping may help to prevent a user's toes from slipping out of transverse openings 124*d*, 124*h*. The teardrop shape openings 124*d*, 124*h* may be achieved via stitching at the portion of openings 124*d*, 124*h* immediately adjacent the sole 102 of the footwear article is closed, while still including an open portion of openings 124*d*, 124*h* between the closed portion and an edge of transverse openings 124*d*, 124*h* adjacent a medial portion of knit upper 106.

In at least one example, a shape and size of all of the transverse openings 124 formed along a length of a footwear article may be the same. However, in other examples, shapes and sizes of the transverse openings 124 may be varied along a length of the footwear article in order to configure the footwear article to have an upper that provides more or less venting and draining in certain portions of the upper, and in order to obtain a comfortable fit of the footwear article (e.g., size and shape the openings so that toes of a user do not exit through the upper of the footwear article). In addition to the size of the transverse openings 124 being important to achieve a comfortable fit for a user, the size of the heel opening 134 and the ankle opening 136 formed into the upper 106, where the ankle opening 136 is an opening defined by the knit upper 106, may also be important to providing a comfortable fit of the footwear article for a user. In particular, the ankle opening 136 is surrounded by heel strap 132 and a medial portion of the knit upper 106.

For example, the ankle opening 136 may be formed with a specific size and shape to accommodate a user positioning their foot into a foot opening of the footwear article and to also provide a fit formed to an ankle of the user. Regarding the heel opening 134 (shown in FIGS. 2-3 and 5-6), the heel opening 134 may be formed into the upper 106 with a specific size and shape so as to prevent a heel of the user from easily slipping out of the footwear article when a foot of the user may be positioned in the footwear article.

Thus, as a size of the openings formed into the upper are selected in order to ensure that a comfortable fit of the footwear article for a user, maintaining the size of these openings or limiting an amount by which the size and shape of these openings may change may be important to ensure that a comfortable fit of the footwear article is maintained during use. For example, it may be important to ensure that some of the openings may change very little in size when a pulling or a pushing force is applied to the openings. Additionally or alternatively, it may be important to ensure that certain openings formed into the upper 106 are able to stretch while also having sufficient elasticity to return to an original size.

In order to limit an amount by which a size and shapes of openings formed into the upper 106 may change, an edge piping 146 may be applied to the knit upper 106 that forms a perimeter around the openings formed into the upper to provide structure for the opening. For example, an edge piping 146 may be provided on an edge of the knit upper 106 that forms at least part of a perimeter of a transverse opening 124. It is noted that in some examples, openings formed into the knit upper 106 may be completely surrounded by the knit upper 106. Thus, in examples where an opening formed into the knit upper 106 is completely surrounded by the knit upper 106, an edge piping 146 may be applied to the edge of the knit upper 106 surrounding the opening, so that the edge piping 146 may also surround the opening formed into the knit upper 106. The edge piping 146 may be applied to the knit upper 106 via any one or combination of gluing, sewing, sonic welding, and other fastening means. In examples where the edge piping 146 may be sewn to the edge of the knit upper 106, a zig zag stitching 234 may be used in order to allow a stretching movement of the knit upper, and in some cases, the edge piping 146 to occur.

However, in some examples, openings formed into the knit upper 106 may only be partially surrounded by the knit upper 106. For example, the knit upper 106 may include openings formed therein that include a portion of a perimeter of the opening formed by the knit upper 106 and a remainder of the perimeter of the opening formed by another portion of the shoe, such as the sole 102, for example. Thus, in embodiments where the knit upper 106 only forms a portion of the perimeter of an opening, the edge piping 146 may be provided on the edge of the knit upper 106 that defines the perimeter of the opening, and the edge piping 146 may only surround a portion of the opening, as opposed to surrounding the opening. In some examples, all of the openings formed into the knit upper 106 may be surrounded by the knit upper. Alternatively, in some embodiments all of the openings formed into the knit upper 106 may only have a portion of their perimeters formed by the knit upper 106. Further still, in some embodiments, a portion of the openings formed into the knit upper 106 may be surrounded by the knit upper 106 while a remainder of the openings formed into the knit upper 106 may only have a portion of the perimeter of the openings formed by the knit upper 106.

The edge piping 146 provided on a portion of the knit upper 106 that forms a perimeter of an opening in the knit upper 106 may be beneficial for providing added structural support. Additionally, the edge piping 146 provided on a portion of the knit upper 106 that forms a perimeter of an opening in the knit upper 106 may limit an amount by which an opening size and shape may be distorted. For example, the edge piping 146 may limit an amount by which an opening size and shape may be changed due to pulling and pushing forces on the opening during use of the footwear article. Additionally, the inclusion of the edge piping 146 on the knit upper 106 may prevent degradation of an edge of the knit material used for the upper. For example, the edge of a knit material may be susceptible to degradation due to stretching and relaxing of the knit weave. However, by applying an edge piping 146 to the edge of the knit material, the edges of the knit material may have additional structural support and may be better protected from degradation.

Additionally, in at least one example, a material of the edge piping 146 applied to the knit upper 106 may be a water resistant material. For example, the edge piping 146 may be formed of a material integrated with TPU, which may provide water resistance benefits. By improving water resistance at an edge of the knit upper 106, water may be prevented from being wicked into a medial portion of the knit upper.

Reducing an amount of water which is wicked into a medial portion of the knit upper, via any one or combination of the above discussed edge piping 146, toe bumper 150, and overlay may be particularly beneficial for the footwear article comprising the knit upper 106. This is not least because the knit material of a knit upper 106 may trap water if the knit material gets wet, causing the footwear article to be uncomfortable to wear. The openings formed into the knit upper 106 may further be beneficial to ventilate and drain the footwear article in a case where the knit upper 106 of the footwear article does get wet, and a material of the sole and footbed may be waterproof, thus resulting in a quick drying time even if the knit upper of the footwear article does get wet. Further, in at least one example, the footbed of the footwear article may be a removable footbed in order to allow for additional venting and draining of the footwear article. For example, in a case where the footwear article may be wet, the removable footbed be removed may assist with venting and draining of the footwear article, so that the footwear article may quickly dry. The ventilation of the footwear article due to openings formed in the footwear article may further be useful to maintain a comfortable temperature for a user during use of the footwear article.

The edge piping 146 applied to the knit upper may have a preselected ductility, tensile strength, and elasticity particular to the opening in which the edge piping 146 is partially or completely surrounding. For example, if it is desirable for an opening formed into a knit upper 106 of a footwear article to limited in how much a shape or size of the openings may be changed, an edge piping 146 applied to the knit upper 106 forming a perimeter around such an opening may have a ductility less than a threshold. For example, the threshold ductility may be an amount of ductility of the knit upper. Thus, the edge piping 146 may be less ductile than the knit upper 106 in order to maintain a shape and size of openings formed in the knit upper 106.

Examples of openings where size increasing and decreasing may need to be limited and where a shape of the opening may be desired to be maintained may include openings proximal a toe region 128 of the footwear article. For example, limiting an amount in which a size and a shape of openings proximal a toe region 128 may change may be desirable to prevent such openings from allowing toes of a user to exit the footwear article through the upper 106.

In some embodiments, the edge piping 146 applied to each of the openings may have the same tensile strength, ductility, and elastic properties. However, any one or combination of tensile strength, ductility, and elastic properties may be varied for the edge piping 146 provided on the knit upper 106 that forms at least a portion of the perimeters of the openings. Varying one or more of tensile strength, ductility, and elastic properties of the edge piping 146 for openings formed in the upper may be useful for controlling an amount of distortion that may occur with the openings.

Further, while it may be desirable to prevent an opening formed in an upper 106 from changing in size and shape, it may also be desirable for certain openings in the upper 106 to allow a change in size and shape. For example, for an ankle opening 136, it may be desirable to enable the ankle opening 136 to expand in size and change in shape to enable a foot to easily be inserted into the footwear article.

However, it may also be important to ensure that the ankle opening 136 retracts following expansion so that the ankle opening 136 may provide a fit formed to an ankle of the user. Furthermore, an edge of the knit upper 106 that forms a perimeter surrounding the ankle opening 136 may be susceptible to degradation. Thus, protecting the edge of the knit upper 106 forming the perimeter surrounding the ankle opening 136 may be important to improve a lifespan of the footwear article.

Therefore, to enable expansion and retraction of the ankle opening 136, and to prevent the edge of the knit upper 106 forming a perimeter surrounding the ankle opening 136 from degrading, the ankle opening 136 may be provided with a ribbed edging (not shown). The ribbed edging may have elastic properties to allow the ribbed edging to be substantially stretched upon application of force to pull the ribbed edging and then retract upon a reduction in application of force that was applied to pull the ribbed edging. The ribbed edging may form a cuff around a perimeter of the ankle opening in at least one example.

Further, in some examples, the perimeter surrounding the ankle opening 136 may include one or more tactile points 152, 154 attached therein to assist manipulation of the perimeter surrounding the ankle opening 136. The one or more tactile points 152, 154 may be tabs or loops attached to the perimeter of the ankle opening 136, for example. The one or more tactile points 152, 154 may be attached to the perimeter of the ankle opening 136 via any one or combination of sewing, gluing, being directly molded to the perimeter of the ankle opening 136, and any other fastening device.

Multiple tabs or loops being attached to the perimeter of the ankle opening 136 of the footwear article comprising a knit upper 106 may make it easier for a user to put on the footwear article comprising a knit upper. The flexible and elastic properties of knit uppers 106 may cause the knit upper 106 to tighten around a user's foot as a user is placing their foot into the footwear article. However, by including multiple tactile points 152, 154 (e.g., tabs and loops), a user may more easily pull the knit upper 106 of the footwear device over their foot.

A first tactile point 154 may be attached to a portion of the knit upper 106 defining a front of the perimeter of the ankle opening and a second tactile point 152 may be attached to a portion of the knit upper 106 defining the perimeter of the ankle opening on a side of the ankle opening 136 opposite the first tactile point. Specifically, the second tactile point 152 may be attached to heel strap 132. The first tactile point 154 and the second tactile point 152 may enable easy manipulation of the portion of the knit upper 106 defining the perimeter of the ankle opening 136 to expand a size of the ankle opening 136. Further, the second tactile point 152 which may be attached to a heel strap 132 of the knit upper 106 may make it easier to pull the knit upper 106 over a heel of a user that has positioned their foot into the footwear article. Any one or combination of sewing, gluing, sonic welding, and other attachment means for attaching the tactile points 152, 154 to the portion of the knit upper 106 defining the perimeter of the ankle opening 136 may be used.

Additionally or alternatively to any one or combination of the features discussed above, the footwear article may further include a lacing system comprising a cord structure, where the cord structure may be beneficial to even further improve a fit of the footwear article to a user's foot. In at least one embodiment, the cord structure may be formed from numerous cord sections interlocking with one another, where at least one of the cord sections may interlock with another cord section via loops. The lacing comprising cord sections which interlock with one another may be advantageous compared to other lacing system approaches where relatively thick straps may directly interlock with a medial cord section or with other relatively thick straps. Specifically, a junction where cords interlock with other cords may be easier to adjust compared to lacing systems where relatively thick straps either directly interlock with other relatively thick straps or where relatively thick straps directly interlock with cords.

The cord sections of the lacing system of the footwear article may include strap cord sections 202, 204, 206, 302, 304, 306, heel cord sections 212, 214, and medial cord section 210, for example. It is noted that the strap cord sections refer to the cord that is positioned on top of the strap. These strap cord sections are separate components from the straps of the footwear article, which have been attached to the straps as a part of the lacing system. Each of the strap cord sections may have a bent end that is adjacent the medial portion of the knit upper. Further details as to the cord sections are described herein at FIGS. 2 and 3.

At least one of the cord sections of the lacing system may pass through a toggle device 120, and the toggle device 120 may enable a cord structure to be held in place following adjusting a position of the cord sections of the cord structure.

For example, the toggle device 120 may enable the cord structure to be tightened to a tightened position and held in the tightened position. In another example, the toggle device 120 may enable the cord structure to be loosened to a loosened position and held in the loosened position. Thus, the cord structure may enable a user to adjust a fit of the footwear article and to maintain the adjusted fit of the footwear article. Specifically, the cord structure may comprise a cord section forming crosses over a medial portion 108 of the knit upper 106, and the cord structure may further comprise one or more separate cord sections which loop to interlock with the cord section crossing over medial portion 108 of the knit upper 106 and then are anchored to a region of the footwear article that is away from the medial portion 108 of the knit upper.

For example, one or more of the straps 110 may include a cord section attached to the strap and which loops to interlock with the cord section forming crosses over the medial portion of the knit upper 108. Additionally or alternatively, the cord structure may include a cord section that is attached to an ankle region 126 of the knit upper 106, where the cord section attached to the ankle region 126 loops to interlock with a portion of the cord section that crosses over the medial portion 108 of the knit upper.

Additionally or alternatively, the cord section attached to the ankle region 126 may be positioned to pass over the cord section crossing over the medial portion 108 of the body. In such examples, the cord section attached to the ankle region 126 of the knit upper may be attached to the knit upper 108 at a location between where the two cord sections are looped to interlock with one another. The cord section attached to the ankle region 126 of the knit upper 106 may further be attached to the knit upper 106 at a location between where the cord section attached to the ankle region 128 of the knit upper 106 passes over the cord section forming crosses over the medial portion of the knit upper 106 and a sole of the footwear article.

Further still, the cord structure may include another cord section that is attached to a lateral portion of an ankle region 126 of the knit upper 106, that wraps around a heel strap 132 of the footwear article, and that is further attached to a lateral portion of an ankle region 126 of the knit upper 106 on an opposite side of the footwear article. More details regarding the cord structure may be described in relation to FIG. 2.

Turning now to FIG. 2, a left side view of a footwear article 200 according to at least one example of the present disclosure is shown. As shown in FIG. 2, the lacing system comprising a cord structure of the footwear article may include one or more strap cord sections, including a first strap cord section 202, a second strap cord section 204, and a third strap cord section 206. Thus, each strap 110 may include a strap cord section attached thereon, where at each strap 110, the strap cord section is narrower than the strap and is trapped against an exterior surface of the strap. The cord structure may further comprise a medial cord section 210, an ankle cord section 208, and one or more heel cord sections 212, 214. In examples where there may be more than one heel cord section, such heel cord sections may be substantially parallel to one another. It is noted that while the footwear article shown includes a lacing system comprising a cord structure, in other embodiments, the footwear article may not include a lacing system and may instead be a pull on footwear article.

While ankle cord section 208 may be separate from the one or more heel cord sections 212, 214, it is noted that in at least one example, ankle cord section 208 may be a part of heel cord section 212. In such examples where ankle cord section 208 is a part of heel cord section 212, the ankle cord section 208 and heel cord section 212 are formed by a same, single piece of cord. Thus, in cases where the ankle cord section 208 is part of the heel cord section 212, a first end of the single piece ankle cord and heel cord section is anchored at a first side of the footwear article and forms a loop that interlocks with medial cord section 210 proximal the ankle opening on the first side of the footwear article. The single piece ankle cord and heel cord section then further wraps around on top of an exterior surface of the heel strap 132 and forms a loop that interlocks with the medial cord section 210 proximal the ankle opening on a second side of the footwear article which is opposite the first side. A second end of the single piece ankle cord and heel cord section which is opposite the first end is further anchored at the second side of the footwear article.

Further, the lacing system may be symmetrical about a longitudinal axis of the footwear article. Thus, as shown in FIG. 3, which is on an opposite side of the footwear article as shown in FIG. 2, there may be additional strap cord sections which correspond with straps on an opposite side of the footwear article and heel cord sections which correspond with the heel on the opposite side of the footwear article. It is noted that corresponding portions of the lacing system on the opposite side of the footwear article from the portions of the lacing system shown in FIG. 3 may include any one or combination of the features described in relation to the portion of the lacing system shown in FIG. 2.

Continuing with FIG. 2, in at least one example, one or more of the cord sections may have both free ends of the cord anchored to a sole 102 of the footwear article. As shown in FIG. 2, the sole 102 may comprise an arch section 105 which may comprise a material that is different than the other material or materials of the sole 102. For example, arch section 105 may comprise a gel material for cushioning purposes. In other examples, arch section 105 of the sole 102 may comprise a material that is less compressible than a remainder of the sole to add structure to the sole 102. Additionally, sole 102 may comprise an outsole 107 comprising a durable material such as a rubber, for example.

In at least one example, a midsole 109 may be fixed to outsole 107. Further, the midsole 109 may comprise a different material than outsole 107, in at least one example. In examples where midsole 109 comprises a different material than outsole 107, the midsole 109 may comprise a material that is more pliable than outsole 107. For example, the midsole 109 may also comprise a rubber that is more pliable than the material of the outsole 107. Alternatively, in at least one example, the midsole 109 may comprise multiple materials. For example, the midsole 109 may comprise a foam and a rubber material, where the rubber material is covers an exterior surface of the foam. The midsole 109 may further extend over at least a portion of the toe to form toe bumper 150, in at least one example.

Anchoring the free ends of the cord of the cord sections to the sole (e.g., a strobel) of the footwear article may help to prevent the cords from coming detached from the upper of the footwear article. For example, the free ends of the strap cord sections, where the free ends of the strap cord section are opposite an end that forms a loop, may be anchored to the sole 102 of the footwear article. The cords may be anchored to the sole of the footwear article by positioning the free ends of the cords between the sole 102 and the knit upper 106 of the footwear article and then fixing the cord via one or more of gluing and sewing the cords to the sole.

However, in at least one example, rather than the strap cord sections on each side of the footwear article being separate pieces, the strap cord sections of each pair of opposing straps may be formed via a single cord. That is, in some examples, each pair of straps of the footwear article positioned across from one another about the longitudinal axis of the footwear article may share a single piece cord to form strap cord sections over each of the straps of the pair. In such examples, a portion of the single piece cord may run through or underneath the sole of the footwear article.

Cord sections trapped against the straps 110 or the heel strap 132 of the footwear article may be pulled on frequently and may be attached to the knit upper. As the strap cord sections 202, 204, 206, the ankle cord section 208, and heel cord sections 212, 214 may be frequently pulled upon, the knit upper 106 may be subjected to a substantial amount of pulling force.

However, by trapping a majority of a length of the cord sections against the knit upper 106 via overlays positioned over the cord sections, the pulling force applied to the knit upper 106 may be dispersed. Dispersing the force applied to the knit upper may be advantageous to prevent a ripping of the knit upper for example.

In at least one example, almost an entire length of each of the strap cord sections 202, 204, 206 may trapped against an exterior surface of the knit upper 106, so that only a loop which is small relative to the length of each of the strap cord sections 202, 204, 206 and cord sections positioned within openings 224 are not trapped against the knit upper 106. It is noted that the length of the strap cord section refers to a length of the strap cord section positioned over the strap and in a looped position.

The majority of the length of each of the strap cord sections that is trapped against an exterior surface of the knit upper 106 may be approximately 80% of the length of each of the strap cord sections and less than an entire length of each of the strap cord sections. Thus, the loops, where the loops are formed by a portion of the cords sections that are not trapped against the exterior surface of the knit upper 106, may be 20% or less of a length of the strap cord section. The loop of each of the strap cord sections 202, 204, 206 may be adjacent a medial portion of the knit upper 108. Regarding the ankle cord section and heel cord sections 212, 214, almost an entire length of these cord sections may also be held against the exterior surface of the knit upper 106.

Additionally or alternatively, the cords may be held in place on the knit upper via one or more overlays positioned over the cords. The one or more overlays may include any one or combination of strap overlays 144 and heel strap overlay 143. For example, the cords may be held in place against the knit upper 106 via an overlay positioned on top of the cords. In examples where the cords may be stitched to the knit upper at an end adjacent a medial portion of the knit upper, the overlay may further serve to protect the stitching used to hold the cord in place from organic matter. Additionally, the overlay may also help to disperse a force applied to the knit upper, thus helping to protect the knit upper from damage.

Furthermore, additional stitching may be provided over the overlay to further help hold the cord in place. For example, block stitching 220 may be provided that stitch the strap overlay 144, the strap cord, and the knit upper 106 together. Such block stitching 220 may only be included at an end of the strap cords proximal the medial portion of the upper 106. In at least one example, there may be two block stitching blocks.

In examples where block stitches 220 may be provided over each strap overlay of the strap cord sections 202, 204, 206 and the ankle cord section 208, the block stitches 220 may be positioned proximal a medial portion of the knit upper, at a location adjacent to where these cord sections may interlock with the medial cord section 210. Placement of the block stitches 220 proximal the medial portion of the knit upper may help to provide additional support near where force due to walking and tightening of the structure may be applied, in order to prevent these cord sections from coming undone from the knit upper of the footwear article. The block stitches 220 over the overlay may stitch through the overlay, the cords of the cord section, and the knit upper in one example.

In at least one example, one or more cutouts 224 may be provided in the overlay that is positioned on top of the cords of the lacing system. Thus, these one or more cutouts may thus be cord exposing cutouts which expose cords positioned directly underneath the respective overlays. In at least one example, a portion of the cords exposed via the cord exposing cutouts may not be directly attached to the knit upper.

In some examples, one or more cutouts 224 may be provided to increase a capacity of certain portions of the overlay to hold portions of the lacing system that may be thicker than a remaining portion of the lacing system. The cutouts 224 formed in the overlay may be approximately oval shaped cutouts **224*a*, for example. However, other shapes may be possible. For example, at least some of the cutouts 224 formed into the one or more overlays may be approximately semicircular shaped cutouts 224*b*, for example. Such approximately semicircular shaped cutouts 224*b* of the one or more overlays may be positioned at a junction of the knit upper 106 and the sole 102** of the footwear article, for example.

In at least one embodiment, the lacing system may include junctions where two cords may overlap, thus causing the location where the two cords overlap to create a portion of the lacing system that is thicker than a remainder of the lacing system which may only include a single cord over the footwear article. Additionally or alternatively, thickening of the lacing system may occur via a diameter of a cord section itself being increased relative to a remainder of the cord section. Thus, to accommodate portions where the lacing system that may be thicker compared to other portions of the lacing system, cutouts 224 in the overlay may be provided where the thickening occurs. For example, a cutout 224 may be provided in an overlay at a location where cords of the lacing system may overlap or where a diameter of a cord section may be increased.

Increasing a capacity of the overlay at certain portions where the lacing system may be thicker, may be beneficial for preventing thicker portions of the lacing system from pushing too tightly against a foot of a user. Specifically, as knit uppers may be soft, if an overlay is provided with a same tight fit for holding both thin and thick portions of the lacing system against the knit upper without increasing a capacity of the overlay where thickening the occurs, the portions where thickening of the lacing system occurs may be felt through the knit upper and may cause discomfort for a user. Additionally, by increasing a capacity of the overlay via openings 224 (i.e., cutouts) in the overlay, a splitting of the overlay may be avoided.

Further, in at least one example, openings 224 formed in the overlay may be formed at an interface of a sole and the knit upper of the footwear article or at specific portions of the overlays that have been predetermined to be frequently flexed. For example such specific portions of the overlay may be frequently flexed due to a curvature of a user's foot or a movement of a user's foot during conditions where the footwear article is in use. Such placement of openings 224 in the overlay may add flexibility to the overlay to prevent the overlay from splitting, for example.

Further, in at least one example, a tab may be sewn to a knit upper, where at least two rows of stitches attach the tab to the knit upper forming an opening between the two rows of stitches, the knit upper, and the tab, and the medial cord section 210 may pass through the opening formed between the tab and the knit upper.

By using any one or combination of the above manners to attach cords of the cord structure to the knit upper, the cords may be held in place while damage to a knit upper may be prevented.

Regarding the cords of the cord structure themselves, the cords may include string, twine, yarn, rope, cable, strands of braided or twisted materials, and/or other cord-like structures. Additionally, a cord shape may be specifically selected to not be too thick, in order prevent discomfort for a user. In particular, as the footwear article comprises a knit upper, and as a cord structure may be utilized on an outside of the knit upper and tightened to hold the knit upper to a foot of a user, cords that are less than a threshold thickness may be selected in order to prevent the cords from causing discomfort to a user when tightening the cord structure. As a knit upper is soft and flexible, the cords may be felt when tightened over the knit upper, as the cords may cause the knit upper to deform. Thus, cords less than a threshold thickness may be selected for the cord structure to prevent discomfort of a user when tightening the cords structure over a foot of the user.

In some examples, a thickness of the cords selected for each section of the cord structure may be a same thickness. However, in other examples, cords for different cord sections of the cord structure may be selected with different thicknesses. For example, a heel cord section 212, 214 may not be tightened over a foot of a user when tightening the cord section. Thus, in some examples, a cord of a heel cord section 212, 214 may be selected that has a thickness that is greater than a thickness of cords selected for remaining sections of the footwear article.

It will be appreciated that descriptions of cord sections in FIG. 2 may also be applied to the corresponding cord sections on an opposite side of the footwear article, for example, the cord section on the opposite side of the footwear article are shown in FIGS. 1, 3, and 6. For example, descriptions provided in relation to FIG. 2 for the first strap cord section 202, the second strap cord section 204, and the third strap cord section, may apply to a fourth strap cord section 302, a fifth strap cord section 304, and a sixth strap cord section 306 shown in FIG. 3, respectively.

The cord structure may include cord sections that interlock with one another with interlocking loops. The cord structure may include a medial cord section 210 which forms a plurality of crosses, and portions of the medial cord section 210 may interlock with other cord sections via loops. The medial cord section 210 may pass through a positioning apparatus 218, where the positioning apparatus 218 may surround and be coupled to the medial cord section 210. In at least one example, the positioning apparatus 218 may be similar to a bead in form. The positioning apparatus 218 through which the medial cord section 210 passes may help to ensure that the medial cord section 210 is centered. The positioning apparatus 218 may be positioned at a section of the medial cord section 210 closest to a toe of the article of footwear.

The medial cord section 210 may form crosses over the medial portion of the knit upper, and the medial cord section 210 may be tightened over the medial portion of the knit upper via pulling on a free end of the medial cord section 210, where the free end of the medial cord section 210 is an end of the cord section including a pull 216. Additionally, the free end of the medial cord section may be an end of the medial cord section forming a loop that does not interlock with another cord section of the cord structure. In at least one example, the free end of the medial cord section 210 may include a pull 216 attached to an end of the medial cord section 210. The pull 216 attached to the end of the medial cord section 210 may comprise a grooved material, making it easier to grip the pull 216 when pulling on a free end of medial cord section 210 to tighten the medial cord section 210. The pull 216 may include a curved profile on one side of the pull 216, where the side of the pull including the curved profile may be a bottom of the pull 216. The curved profile on a bottom of the pull 216 may enable the pull 216 to lie flat or to hook onto the medial cord section. Additionally, the curved profile on a bottom of the pull 216 may make it more comfortable to hold the pull 216 when using the pull 216 to tighten the medial cord section 210.

When the pull 216 is pulled to tighten the medial cord section 210, cord sections that are interlocked with the medial cord section 210 may be pulled by the medial cord section 210 towards a center of the footwear article. For example, when tightening the medial cord section 210, strap cord sections that may be interlocked with the medial cord section 210 may be pulled towards a center of the footwear article, and pulling the strap cord sections towards the center of the footwear article may pull the straps towards the center of the footwear article. Furthermore, in at least one example, the pull 216 may also function as a toggle.

In some examples, each strap of a footwear article may include a strap cord section. However, in other examples, some or none of the straps of the footwear article may include strap cord sections. In examples where straps include strap cord sections, the strap cord sections may be attached to a knit upper of the shoe that is forming a strap. For example, a strap cord section may be attached to a top of the knit upper of a shoe. Any one or combination of sewing, gluing, overlays, and other attachment apparatuses may be used to hold strap cord sections against the knit upper of the shoe.

In the footwear article shown at FIG. 2, the first strap cord section 202, second strap cord section 204, and third strap cord section 206, may each be positioned on a strap of the footwear article. One or more of the first strap cord section 202, second strap cord section 204, and third strap cord section 206 may each be attached to the knit upper of the footwear article such that these strap cord sections each form a loop that interlocks with the medial cord section 210. In particular, one or more of the strap cord sections 202, 204, 206 may form a guiding loop at a medial portion of the footwear article, and this guiding loop may interlock with a medial cord section 210 of the footwear article. Similarly, in at least one example, the ankle cord section 208 may also form a guiding loop at a medial portion of the footwear article, and the medial cord section 210 of the footwear article may interlock with the guiding loop of the ankle cord section 208. Then the strap cord sections 202, 204, 206 each are further attached to the upper knit forming a corresponding strap.

Thus, by interlocking each of the strap cord sections 202, 204, 206 with the medial strap cord section 210, where each of the strap cord sections 202, 204, 206 are attached to a strap of the footwear article, when the medial cord section 210 is tightened towards a center of the footwear article by pulling a free end of the medial cord section 210, the loops of the strap cord sections interlocking the medial cord section 210 cause the strap cord sections 202, 204, 206 to also be pulled towards the center of the footwear article.

As the strap cord sections 202, 204, 206 are attached to corresponding straps of the footwear article, these straps may also be pulled towards a center of the footwear article. Thus, by tightening the medial cord section of the cord structure, the straps of the footwear article may be pulled towards a center of the footwear article, tightening the footwear article over a foot of a user. Similarly, if a medial cord section 210 is loosened, then the strap cord sections 202, 204, 206 may be able to move away from the center of the footwear article, loosening a fit of a footwear article over a foot of a user. After adjusting a medial cord section 210, a toggle 120 through which the medial cord section 210 passes may be used to hold the medial cord section 210 in position.

Additionally or alternatively, an overlay may be used to attach the strap cord section 202, 204, 206 to a portion of the knit upper of the footwear article forming a strap. For example, an overlay may be positioned over a the strap cord so that the strap cord section is positioned between the knit upper and the clear material overlay, thus helping to hold the strap cord section in place.

Furthermore, the overlay may provide additional support for the straps of the footwear article, which may be beneficial for overall improved lateral support of the footwear article. The overlay may be a plastic overlay, such as TPU or PU. In at least one example, the overlay may be fastened to the knit upper of the footwear article via any one or combination of molding directly onto the knit upper, gluing, sewing, and any other fastening apparatus, for example. In at least one example, one or more block stitches 220 may be used to both fasten an overlay to the knit upper of the footwear article and to fasten a cord section to the knit upper of the footwear article, where the cord section may be positioning between the overlay and the knit upper.

In addition to strap cord sections 202, 204, 206 and the medial cord section 210, the cord structure of the footwear article may further include an ankle cord section 208. The ankle cord section 208 may be attached to a lateral ankle region of the knit upper of the footwear article via one or both of block stitching and a clear material overlay. For example, the ankle cord section 208 may be attached to the knit upper of the footwear article via the lateral ankle overlay 142.

The lateral ankle overlay 142 may include an opening 224, where in the opening 224 of the lateral ankle overlay 142, the ankle cord section 208 may overlap medial cord section 210 and the medial cord section 210 may form a first interlocking loop with the ankle cord section 208. Additionally, the ankle cord section 208 may form a second interlocking loop 226 with the medial cord section 210 at an end of the ankle cord section 208, where the second interlocking loop 226 may act as a guide for the medial cord section 210 and where the first interlocking loop may cause the ankle region of the upper to be pulled towards a center of the footwear article upon tightening of the medial cord section 210. Thus, in at least one example, tightening of the medial cord section 210 may cause the lateral ankle overlay 142 to be pulled towards a center of the footwear article. The lateral ankle overlay 142 may be any one or combination of stitched and glued to the knit upper of the footwear article. For example, the lateral ankle overlay may be stitched along an entire perimeter of the lateral ankle overlay 142 to the knit upper. This may be advantageous for both preventing a tearing of the knit upper by dispersing a force applied to the lateral ankle overlay 142 and for ensuring that the ankle cord section 208 and that the heel cord sections 212, 214 are securely fastened to the knit upper. Further, tightening the medial cord section 210 may cause the heel cord section 212 to tighten an ankle opening 136.

The lateral ankle overlay 142 may include a Y-shaped section 226. The Y-shaped section 226 of the lateral ankle overlay 142 may provide a guide for positioning a top ankle cord section 208 and heel cord sections 212, 214, for example. Further, the Y-shaped section 226 of the lateral ankle overlay 142 may be a region of the lateral ankle overlay 142 that may be thicker than a remainder of the lateral ankle overlay 142. In examples where this Y-shaped region 226 may be thicker than a remainder of the lateral ankle overlay 142, the Y-shaped region 226 may function to provide additional lateral ankle support at the Y-shaped region 226, compared to the lateral support added by the remainder of the lateral ankle overlay 142, where the remainder of the lateral ankle overlay 142 is a region of the lateral ankle overlay 142 excluding the Y-shaped region 226. Providing a varied amount of support via the lateral ankle overlay 142, specifically with a Y-shaped region 226 of the lateral ankle overlay 142 providing more support than a remainder of the lateral ankle overlay 142, may be advantageous for allowing some lateral flexibility while preventing complete lateral bending of the footwear article. Furthermore, in at least one example, the Y-shaped region 226 of the lateral ankle overlay 142 may guide one or more of the ankle cord section 208, heel cord section 212, and heel cord section 214. However, in other examples, the Y-shaped region 226 may not specifically guide one or more of the ankle cord section 208, heel cord section 212, and heel cord section 214, and the lateral ankle overlay 142 may instead function to simply hold the one or more of the ankle cord section 208, heel cord section 212, and heel cord section 214 against the knit upper of the footwear article.

Additionally or alternatively, the cord structure may include one or more heel cord sections 212, 214. The heel cord sections 212, 214 may help to provide additional structure to the footwear article. The heel cord sections 212, 214 may be attached to the knit upper. For example, the heel cord sections 212, 214 may be attached via any one or combination of gluing the heel cord sections 212, 214 to a top surface of the knit upper, sewing the heel cord sections 212, 214 to a top surface of the knit upper, and utilizing any other fastening device to attach the heel cord sections 212, 214 to the knit upper. Additionally or alternatively, the heel cord sections 212, 214 may be positioned between a clear material overlay (e.g., TPU). The heel cord sections 212, 214 may be attach at a first lateral portion of an ankle region of the upper of the footwear article, wrap around a heel (e.g., heel strap 132) of the footwear article, and attach at a second lateral portion of the ankle region of the upper of the footwear article that is on a side of the footwear article opposite the first lateral portion of the ankle region.

Turning to FIG. 3, a right side view of the second example footwear article 300 is shown. The footwear article 300 includes fourth strap cord section 302, fifth strap cord section 304, and sixth strap cord section 306. As discussed above in relation to FIG. 2, fourth strap cord section 302, fifth strap cord section 304, and sixth strap cord section 306 are strap cord sections on straps that are on an opposite side the medial portion of the knit upper from a first strap cord section 202, second strap cord section 204, and third strap cord section 206, respectively. Put another way, strap cord sections 202, 204, and 206 are across from strap cord sections 302, 304, and 306, respectively. Similar descriptions which applied to strap cord sections 202, 204, 206 may be applied to strap cord sections 302, 304, 306. For example, similar attachment means and interlocking descriptions from strap cord sections 202, 204, 206 may be applied to strap cord sections 302, 304, 306.

Figure 4:
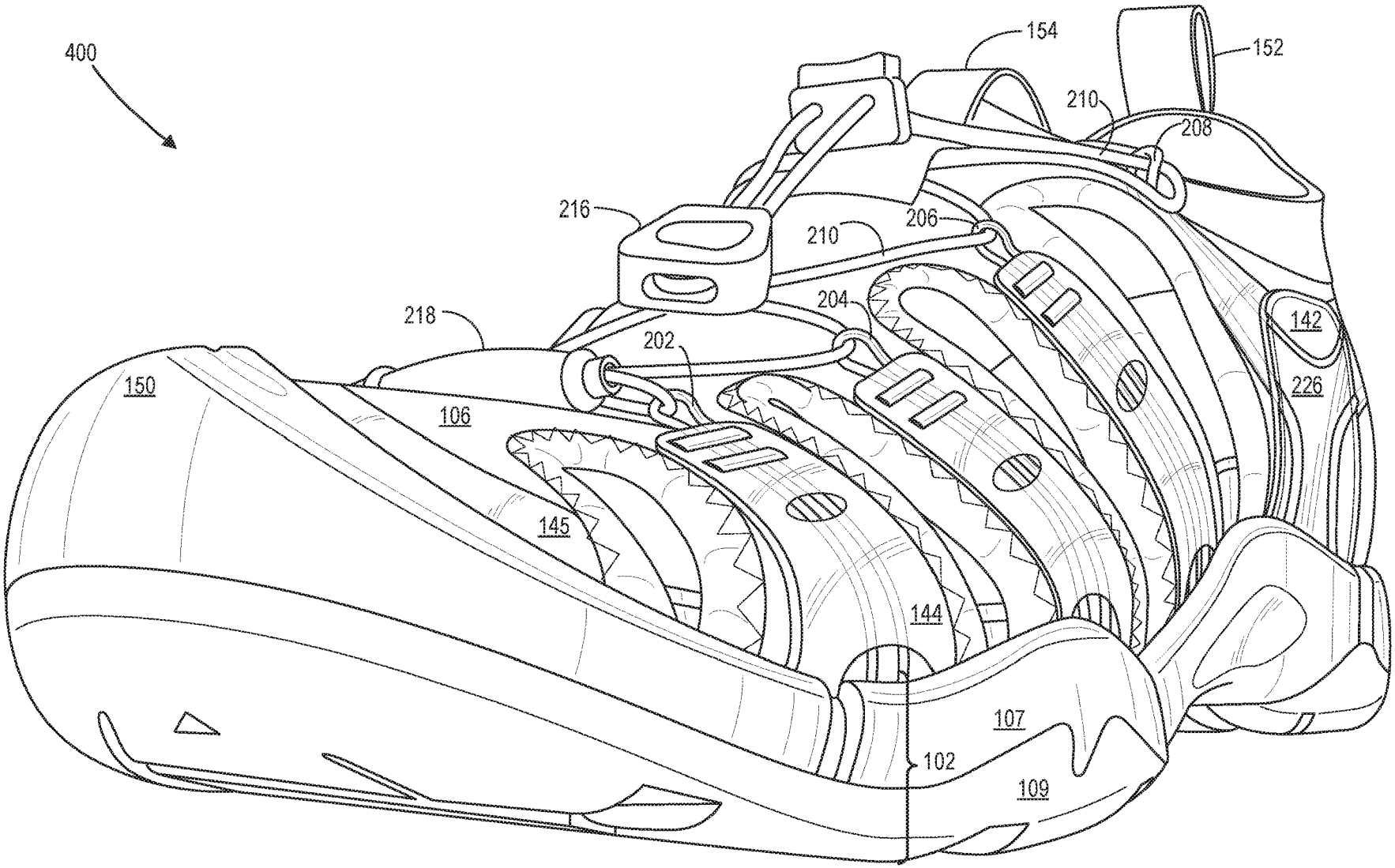
FIG. 4 shows a front perspective view of the example footwear article according to at least one example of the present disclosure.

Turning to FIG. 4, FIG. 4 shows a front perspective view 400 of the footwear article, according to at least one embodiment of the present disclosure. The front perspective view 400 of the footwear article shows the interlocking loops of the medial cord section 210 with the strap cord sections 202, 204, 206 and with ankle cord section 208 in greater detail. In particular, via the front perspective view 400 shown at FIG. 4, the junctions between the medial cord section 210, the strap cord sections 202, 204, 206, and the ankle cord section 208 may be seen more easily. It is noted that not all components of the footwear article shown in front perspective view 400 are labeled in order to make it easier to view the junctions at which the strap cord sections 202, 204, 206 interlock with the medial cord section 210.

Turning now to FIG. 5, FIG. 5 shows a rear end view 500 of the footwear article, according to at least one example. As may be seen in FIG. 5, the tactile point 152 is positioned on top of the heel strap overlay 143, the heel cord sections 212, 214, and the heel strap 132, where the heel strap 132 is a part of the knit upper 106. Thus, heel cord sections 212, 214 are positioned between the heel strap 132 and the heel strap overlay 143, and the tactile point 152 is positioned on top of the heel strap overlay 143. In at least one example, the tactile point 152 may be fixed to the footwear article via stitching passing through both the heel strap overlay 143 and the heel strap 132. Such a manner of fixing the tactile point 152 may beneficially strengthen a connection between the heel strap overlay 143 and the footwear article, for example. However, in at least one example, tactile point 152 may be attached to the footwear article via another fixing means such as gluing. Furthermore, as also seen at FIG. 5, the upper 106 may be positioned between the footbed 130, and between the sole 102, the sole 102 further positioned directly underneath the upper 106.

Figure 6A:
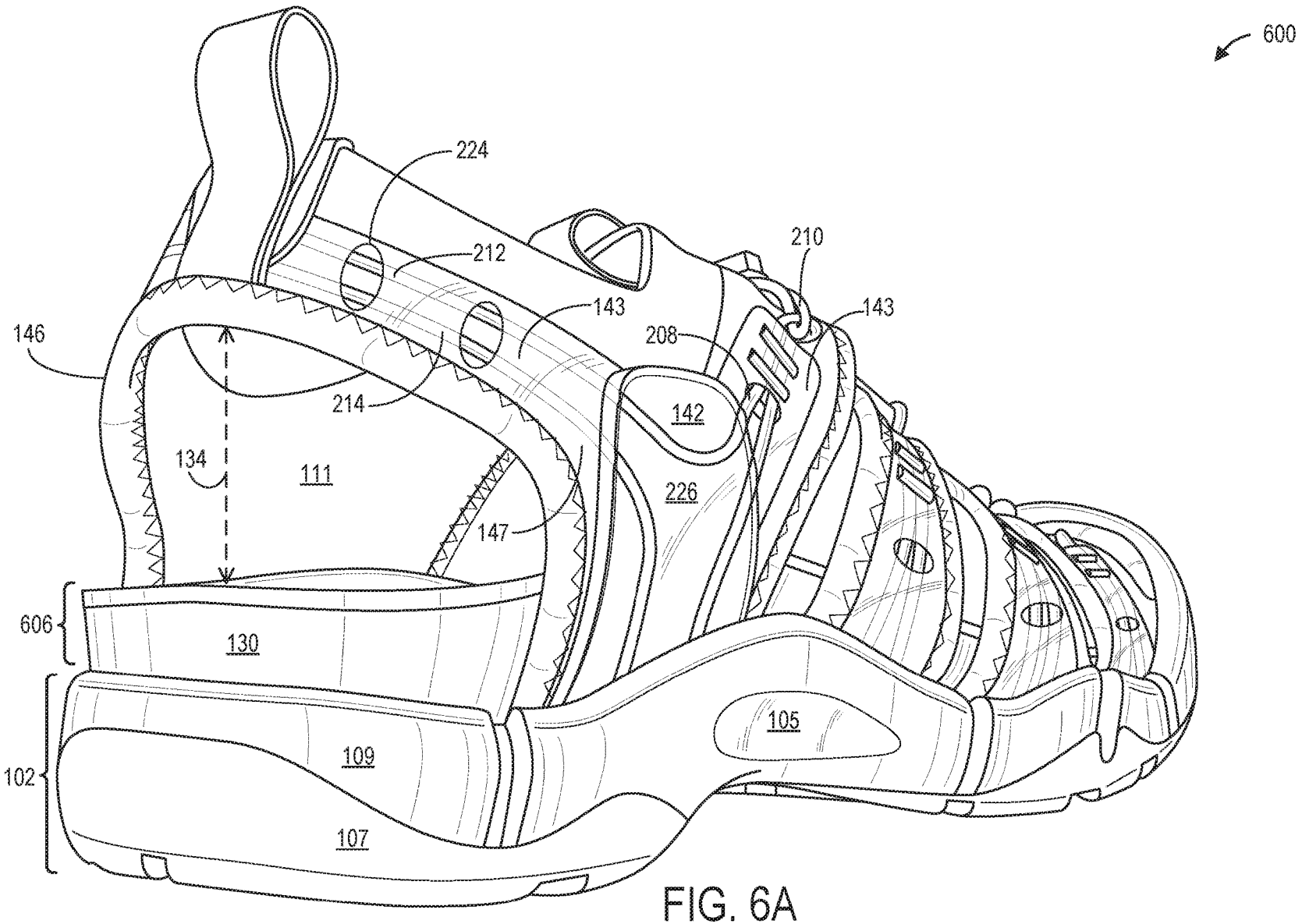
FIG. 6A shows a rear perspective view of the example footwear article, according to at least one example of the present disclosure.
Figure 6B:
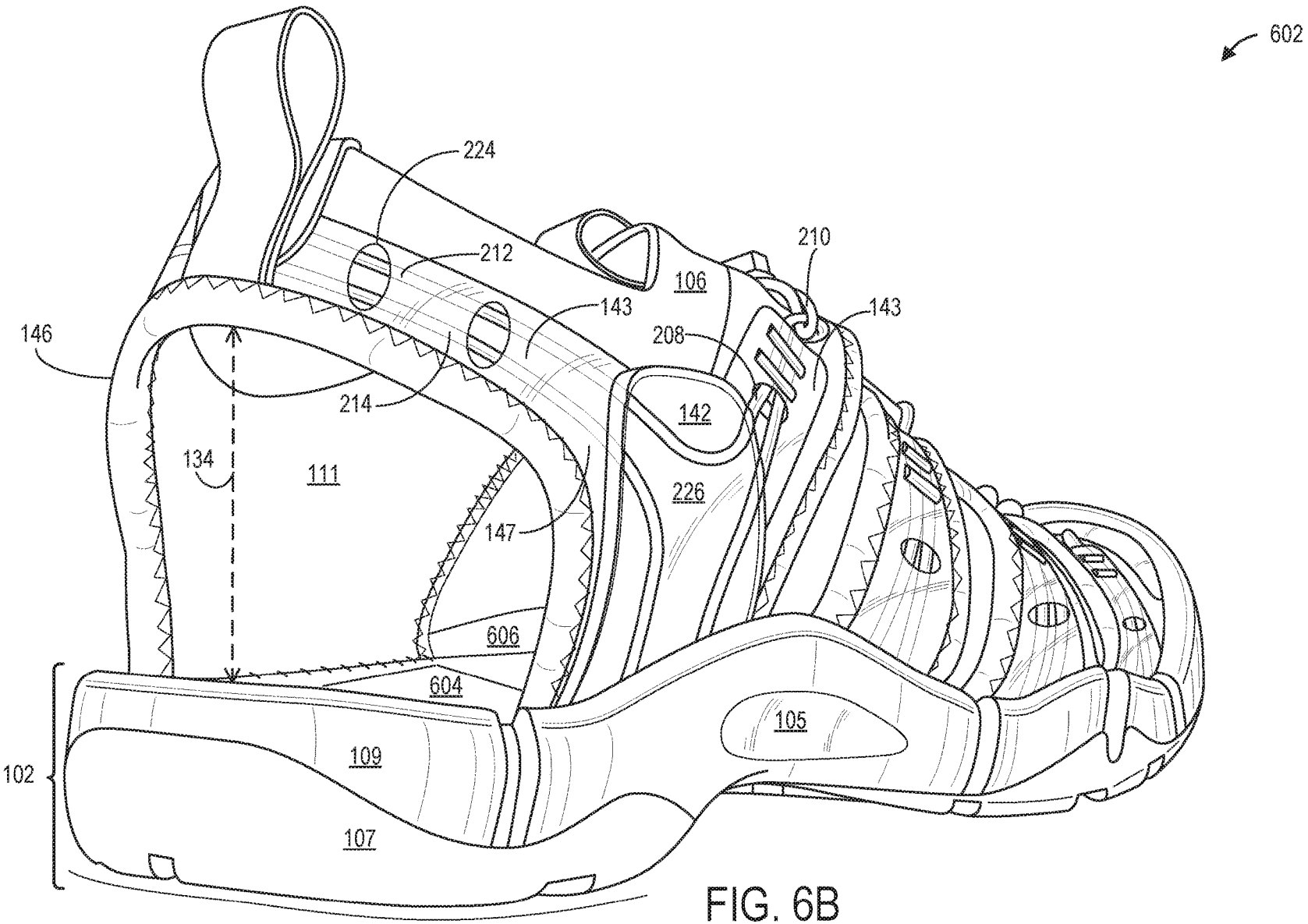
FIG. 6B shows a rear perspective view of the example footwear article according to at least one example of the present disclosure, where a footbed of the footwear article has been removed.

Turning now to FIGS. 6A and 6B, FIGS. 6A and 6B show perspective rear views 600, 602 of the footwear article according to at least one example of the present disclosure. Perspective rear view 600 of the footwear article may be for viewing purposes where footbed 130 is coupled to the footwear article. Perspective rear view 600 of the footwear article may be for viewing purposes where the footbed 130 is not coupled to the footwear article.

In at least one example, the footbed 130 may be formed integrally with the sole 102 of the footwear article. Thus, in such examples where the example footwear article includes a footbed 130 that is formed integrally with the sole 102, perspective rear view 602 does not apply. However, in other examples, footbed 130 may be a removable footbed, and footbed 130 may be received by a corresponding receiving portion formed into a top of sole 102, so that the footbed 130 may be held securely in the receiving portion of the sole 102. Thus, in examples where the example footwear article includes a footbed 130 that is a removable footbed, both rear perspective views 600 and 602 may apply. In one or more examples, the footbed 130 may comprise a water resistant material.

Footbed 130 is positioned between an inner surface 111 of the knit upper of the footwear article and a top of sole 102. In particular, a receiving portion may be in within the receiving portion of the sole 102, such as a recess formed in a top of the sole 102, the footbed 130 may be coupled to the sole 102.

Further, when the footbed 130 may be coupled to the sole 102, the footbed 130 may be positioned between a top of the sole 102 and a foot receiving opening, where the foot receiving opening is formed between a top of the footbed 130 and the upper of the footwear article.

The footbed 130 may include a border 606 around a perimeter of the footbed 130 that is raised relative to a body of the footbed 130, and when coupled with the sole 102, the border 606 of the footbed 130 may extend upwards higher than an upper edge of the sole 102 to improve a fit of a footwear article 130 for a user. Thus, the footbed 130 may form a portion of an exterior of the footwear article when the footbed 130 is coupled to the footwear article.

The footbed 130 may be held within the footwear article at least in part due to an upper edge of the sole 102 (e.g., midsole 109) of the footwear article which forms a lip that overlaps with at least a portion of border 606 of footbed 130 when the footbed 130 is coupled to the footwear article. In at least one example, an interior surface 606 of the sole 102 (e.g., interior surface of midsole 109) may be in contact with at least a portion of border 606 of footbed 130. Thus, the top of the sole 102 includes a rim around a perimeter of the sole 102 that is raised relative to a remainder of the top of sole 102 and forms a lip around the perimeter of the footwear article. Thus, the top of the sole 102 may form receiving depression for receiving footbed 130. That is, the top of the sole 102 may form a cup for receiving footbed 130.

In at least one example, a border of the footbed 130 may extend upwards above an edge of sole 102 and into a heel opening 134 of the footwear article when the footbed 130 is coupled to the sole 102. Additionally, an edge of the footbed 130 may be raised so that a knit upper of the footwear article may be in contact with the footbed 130, and the knit upper may help to hold the footbed 130 in place.

In further examples, footbed 130 may comprise a foot insert which is received by a body of the footbed 130. Further details as to the foot insert are provided at FIGS. 7A and 7B.

Figure 7A:
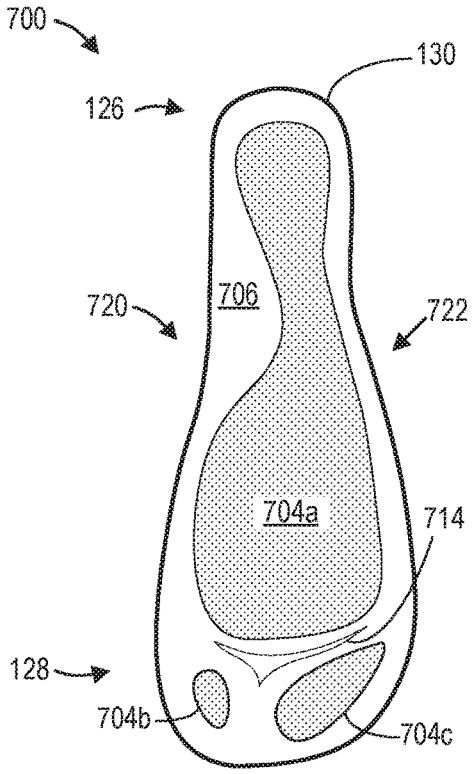
FIG. 7A shows a schematic top view of an example footbed according to at least one example of the present disclosure.
Figure 7B:
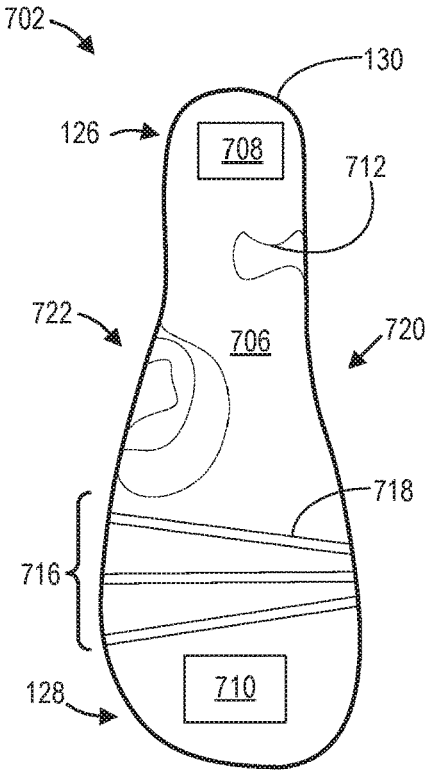
FIG. 7B shows a schematic bottom view of a bottom of the example footbed according to at least one example of the present disclosure.
Figure 8:
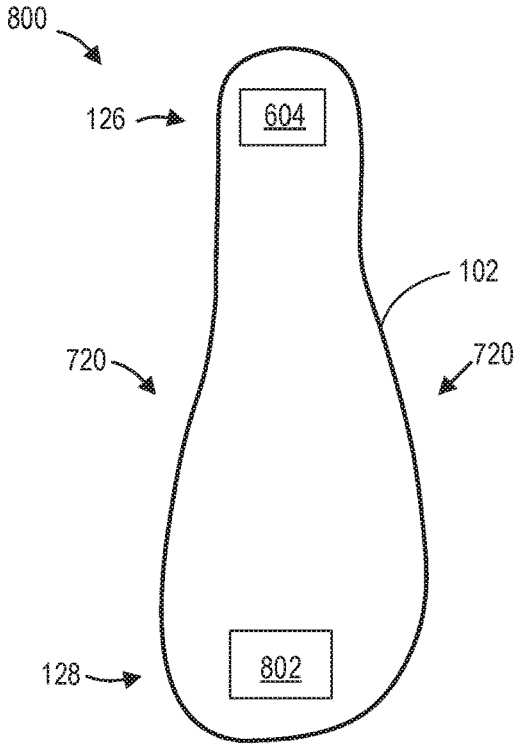
FIG. 8 shows a schematic top view of a top of a sole of the footwear article according to at least one example of the present disclosure.

As shown in rear perspective view 602 of the example footwear article where the footbed has been removed for viewing purposes, a top of the sole 102 includes an attachment region 604, which may mate with an attachment region of the footbed 130 as described at FIGS. 7A-8. In particular, attachment region 604 may be a heel attachment region of the footwear article. Moreover, as also seen in rear perspective view 602, upper 106 may be stitched to the top of the sole 102. In at least one example, the upper 106 may be sewn to a separate component that is to form the top of sole 102 during manufacturing, and then the upper and the separate component material that is to form the top of the sole 102 may be glued to a remainder of the sole. For example, the material that forms the top of the sole 102 may be glued to a top of midsole 109. Moreover, in at least one example, attachment fabrics may be glued to an inner surface of the midsole, and the top of the sole 102 may be sewn to such attachment fabrics.

Turning to FIG. 7A, a schematic top view 700 of a footbed 130 according to at least one example of the present disclosure is shown. In at least one example, footbed 130 may comprise one or more foot support inserts 704*a*, 704*b*, 704*c*, and a body 706. As shown in FIG. 7A, the foot support inserts 704 may include a sole support 704*a*, a first toe support 704*b*, and a second toe support 704*c*. However, other configurations may be possible.

In examples where the footbed 130 includes a foot support inserts 704, the foot support inserts 704 may be shaped approximately to align with a portion of a user's foot which may be in contact with a top of the footbed 130 during use of the footwear article. For example, the foot support inserts 704 may include raised regions 714 which may align with a user's toes during use for added comfort. The foot support inserts 704 of the footbed 130 may comprise a material specifically adapted to provide comfort and support for a foot of a user. In some examples, the foot support inserts 704 may comprise one of a gel, a foam, or PU, for example.

The foot support inserts 704 and the body 706 of the footbed 130 may be formed of a first material and a second material, respectively, where the first material is different from the second material, in at least one example. However, in other examples, the material of foot support inserts 704*a*, 704*b*, 704*c* may be different from both the body 706 and from each other. For example, sole support insert 704*a* may comprise a material that is different than both the body 706 and different than the first toe support 704*b* and the second toe support 704*c*. Such variation of the materials may be to improve comfort and support for a user. Alternatively, in one or more examples, the foot support inserts 704 may comprise a same material as the body 706 of the footbed 130.

Additionally, a texture of the foot support inserts 704, indicated by a dotted pattern, may differ from a texture of the body 106. For example, a texture of the foot support inserts 704 may be a gripping texture and the texture of the body 706 may be a texture that is more smooth than the gripping texture of the foot support inserts 704. Such variation in texture may beneficially help to maintain proper alignment of a user's foot within a footwear article comprising the footbed 130. Moreover, in one or more examples, the material of the foot support inserts 704 may be an anti-odor material.

The body 706 of the footbed may comprise any one of PU, TPU, or EVA, for example. In one embodiment, the foot insert may be coupled to the body 706 of the footbed 130 by gluing the foot insert to the body 706 of the footbed 130. For example, the body 706 of the footbed 130 may include a recess for receiving the foot support inserts 704, where a size and shape of the recess formed into the body 706 of the footbed 130 corresponds to the size and shape of the foot support inserts 704. The foot support inserts 704 may further be glued into the recess formed into the body 706 of the footbed 130 to provide a strong coupling between the foot support inserts 704 and the body 706 of the footbed 130. However, in other examples, the foot support inserts 704 may be formed integrally with the body 706 of the footbed 130. For example, the foot insert 704 may be formed integrally with the body 706 of the footbed 130 via a molding process.

Turning now to FIG. 7B, a schematic bottom view 702 of the footbed 130 according to at least one embodiment of the present disclosure is shown. As may be seen in FIG. 7B, a bottom of footbed 130 may include one or more attachment means for coupling the removable footbed 130 to the footwear article. For example, the attachment means may include one or more of a toe attachment region 710 at a toe of the footbed 130 and a heel attachment region 708 at a heel of the footbed 130. However, more attachment regions or fewer attachment regions on a bottom of the footbed 130 may be possible. Additionally or alternatively, a size and shape of each attachment region may be varied. In at least one example, it may be desirable to minimize a size of a toe attachment region 710 and a heel attachment region 708, so that it may be easy to insert and remove the footbed 130 from the footwear article.

In at least one example, the attachment regions 708, 710 at a bottom of the footbed 130 may be loop and hook regions for mating with a receiving portion of the top of the sole 102 of footwear article. However, other attachments means such as a temporary glue may be possible.

Additionally or alternatively, the footbed 130 may include grooved sections 712, where the grooved sections 712 may be positioned on the sides and a bottom of the footbed 130. In examples where the footbed may include grooved sections 712, the grooved sections 712 may be recessed relative to a body 706 of the footbed 130. For example, the grooves 712 may be recessed relative to a bottom surface or a side surface of the footbed 130. In at least one example, the grooved sections 712 may be etched into the bottom of the footbed 130. However, in other examples, the footbed 130 may be molded with grooved sections 712. The grooved sections 712 of a bottom of a footbed 130 may help to improve a grip of the footbed 130 in the footwear device, for example. Further, the grooving may be beneficial to assist with draining and venting on a bottom of the removable footbed.

Additionally or alternatively, the footbed 130 may comprise one or more flex grooves 718 that form a flex region 716 of the footbed 130. For example, the footbed 130 flex grooves 718 be regions that are thinner than a remainder of the footbed 130 in order to improve a flexibility of the footbed 130 at the flex region 716. The flex grooves 718 may not be parallel to one another in at least one example. For example, the flex grooves 718 may be closer to one another at a medial side 720 of the footbed 130 compared to a spacing of the flex grooves 718 from one another at a lateral side 722 of the footbed 130. Moreover, the flex region 716 of the footbed 130 may be at a toe side 128 of the footwear article. Such positioning of the flex grooves 718 of the flex region 716 may be beneficial for the footbed 130 to flex with a movement of a user's foot during use.

In some examples one or a combination of types of attachment means may be used to couple a removable footbed 130 to the top of sole 102 of the footwear article. As discussed above, footbed 130 of the footwear article may be made with EVA. Thus, a footbed 130 comprising PU may be more durable and replacement of a footbed 130 that may be made of PU may be made less frequently than other materials such as EVA. However, other materials of the footbed 130 may be possible.

The attachment regions 708, 710 on a bottom of footbed 130 may mate with a top of a sole 102 of a footwear article, as shown at FIG. 8

In particular, FIG. 8 shows a schematic top view 800 of the top of sole 102 of the footwear article. As shown in FIG. 8, the top of sole 102 may comprise a toe attachment region 802 and a heel attachment region 604. Thus, heel attachment region 708 on the bottom of footbed 130 may be coupled with heel attachment region 604, and toe attachment region 710 on the bottom of footbed 130 may be coupled with the toe attachment region 802 of the footbed 130. In some examples the footbed toe attachment region 710, the footbed heel attachment region 708 may be coupled with the corresponding sole toe attachment region 802 and sole heel attachment region 604 via a loop and hook mechanism.

In examples where the attachment regions 708, 710 of the footbed 130 may comprise a loop and hook material, a material of the top of the sole 102 of the footwear article may also comprise loop and hook material in order to enable the footbed 130 to couple with the top of the sole 102. In some examples, the top of the sole 102 of the footwear article may all be made of a corresponding attachment material (e.g., loop and hook) for coupling the footbed 130. Alternatively, the only a heel attachment region 604 and a toe attachment region 802 may comprise a loop and hook material.

For example, only a portion of the top of the sole of the footwear article may comprise an attachment material corresponding to the attachment regions on a bottom of the footbed 130. In embodiments where the attachment regions of a footbed 130 may include a toe attachment region 710 and a heel attachment region 708 of the footbed 130, both the toe attachment region 710 and the heel attachment region 708 may comprise an attachment material, and the footbed may not include an attachment material between the toe attachment region 710 and the heel attachment region 708. Further, in such examples, the top of the sole 102 of the footwear article may only comprise a corresponding attachment material for the toe attachment region 710 and the heel attachment region 708 at regions corresponding to the attachment regions of the footbed 130. Thus, in an example where the attachment regions of the footbed 130 may only be at a toe and at a heel of the footbed, the top of the sole for receiving the footbed 130 may only include corresponding attachment material at a toe and at a heel of the top of the sole.

However, in other examples, to simplify both construction of the top of the sole and to make it easy to place the footbed 130 into a receiving portion of a top of the sole of the footwear article, an entire top of the sole of the footwear article may comprise the corresponding attachment material, even though the footbed may only comprise attachment regions on a portion of a bottom of the footbed.

Additionally or alternatively, the footbed attachment regions 708, 710 may protrude from a bottom surface of the footbed 130 and the sole attachment regions 604, 802 may be corresponding receiving portions formed into the top of the sole 102 of the footwear article 130. For example, the sole attachment regions may correspond in shape and positioning with the attachment regions of the footbed 130. Thus, if the footbed 130 includes a toe attachment region 710 and a heel attachment region 708 that are raised relative to a bottom surface of the footbed 130, then the attachment regions 604, 802 of the top of the sole 102 may be corresponding receiving portions for the footbed attachment regions 708, 710 that are recessed relative to a top surface of the sole 102 and that are positioned at a toe and at a heel of the sole 102.

By the attachment regions 604, 802 additionally or alternatively being receiving portions in the top of the sole 102 that are recessed relative to the top surface of the sole 102 for receiving attachment regions 708, 710 of the footbed 130, a strong, tight coupling of the footbed 130 to the sole 102 may be achieved. Furthermore, the footbed and the sole of the footwear article may remain coupled, even as attachment means (e.g., loop and hook) may wear out.

That is, a shape of the top of the sole that receives the footbed 130 may be recessed, so that in addition to the attachment regions, the footbed 130 and the sole of the footwear article may be coupled via a shaping of the sole itself. For example, a top of the sole may include raised edges around all or a portion of the perimeter of the top of the sole, so that when the footbed 130 may be positioned in the receiving portion of the sole, the footbed 130 may be held in place at least in part due to the raised edges of the sole. By utilizing both a receiving shape of the top of the sole and specific attachment material for coupling the footbed with the footwear article, a stronger coupling may be formed.

However, in other examples, attachment regions of the footbed may be substantially flush with a bottom surface of a footbed, as opposed to being raised relative to a bottom surface of a footbed. Forming attachment regions that are substantially flush with a bottom surface of a footbed may be advantageous for simplifying construction of the sole of the footwear article, for example.

Figure 9:
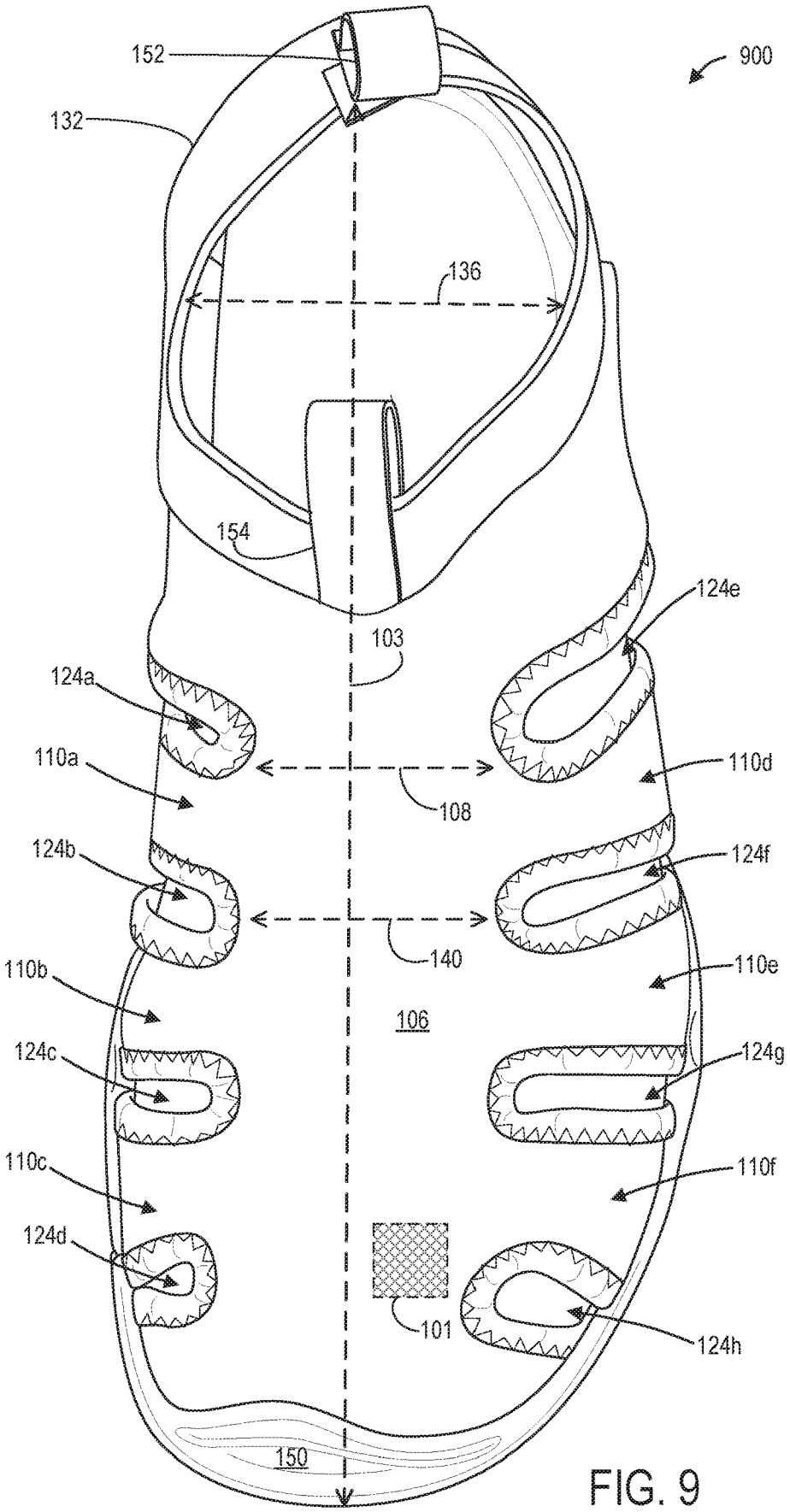
FIG. 9 shows a top view of the example footwear article according to at least one example of the present disclosure, where the overlays, lacing system, and footbed have been removed for viewing purposes.

Turning now to FIG. 9, FIG. 9 shows a top view 900 of a footwear article according to at least one example of the present disclosure, where a lacing system, overlays, and footbed of the footwear article have been removed for viewing purposes.

As shown in top view 900, the upper 106 comprising a knit material 101 is a single, unitary piece. The single piece upper 106 comprises a body 108, also referred to herein as a medial portion, and a plurality of straps 110 which extend in a transverse direction from the body. The straps 124 of the upper 106 may be symmetrical about a longitudinal axis 103 of the upper 106. Further, between each pair of adjacent straps 110, there is an opening 124 is formed into the upper 106. There are further openings 124 formed into the knit upper between a straps 110*a*, 110*d*, and an ankle region of the upper 106, as well as openings formed between straps 110*c*, 110*f* and a toe region of the upper 106. The single piece upper 106 further includes a heel strap 132, where an ankle region of the upper 106 and the heel strap 132 define a perimeter of an ankle opening 136. Tactile points 152, 154 may be fixed to a portion of the upper 106 forming the perimeter of ankle opening 136 to make it easier to manipulate a size of the ankle opening 136.

Figure 10:
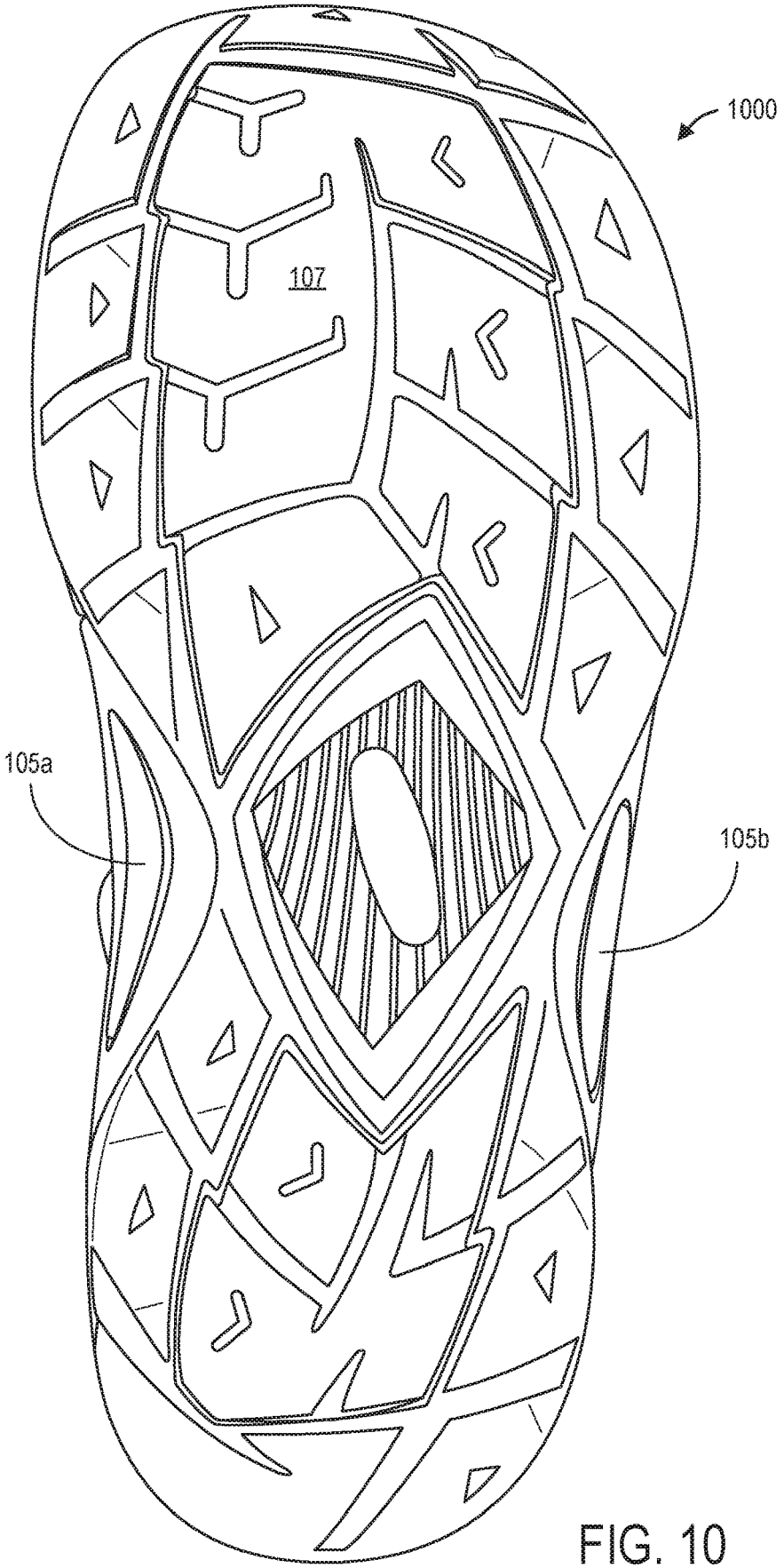
FIG. 10 shows a bottom view of the example footwear article, according to at least one example of the present disclosure.

Turning to FIG. 10, FIG. 10 shows a bottom view 1000 of the footwear article. As shown in FIG. 10, arch sections 105*a*, 105*b* are positioned at contoured portions of the footwear article between the toe region 128 and the heel region 126 of the footwear article. Further, the bottom view 700 shows contours of the outsole 107 of the footwear article which may be beneficial for improved grip of the footwear article during use.

Thus provided herein is a footwear article. In at least one example, the footwear article may comprise a single-piece knit upper including a knit medial portion and a plurality of knit straps extending from the knit medial portion. A medial cord section may be positioned on top of the knit medial portion, and a plurality of strap cord sections, each positioned on top of a corresponding knit strap of the plurality of knit straps may further be included. Each of the strap cord sections may form a loop that interlocks with the medial cord section, in at least one example, and a sole may be coupled to the knit upper.

Additionally, a plurality of strap overlays, each of the plurality of strap overlays positioned over a corresponding strap cord section of the plurality of strap cord sections may be included. In another example footwear article which may include any one or combination of the previous example footwear articles, each of the plurality of strap overlays may cover approximately 80% of a length of the corresponding strap cord section. Furthermore, in at least one example, each of the plurality of strap overlays may include one or more openings formed therein.

In another example footwear article, which may include any one or combination of the above features, the single-piece knit upper further includes a knit heel strap. Further, a heel cord section may be positioned over the knit heel strap and a heel strap overlay positioned over the heel cord section. In some examples, the example footwear article may include a removable footbed coupled to a top of the sole, the removable footbed forming a portion of an exterior of the footwear article.

In yet another example footwear article which may include any of the features described above, the footwear article may comprise a knit upper, the knit upper including a knit medial portion, and a plurality of knit straps extending from the knit medial portion. The plurality of knit straps may be adjacent to one another in a longitudinal direction of the footwear article, and an opening defined by an edge of the knit upper may be formed between each pair of adjacent straps, for example. Furthermore, an edge piping fixed to the edge of the knit upper defining the opening formed between each pair of adjacent straps. A lacing system comprising a plurality of cord sections as described above may be positioned over the knit upper and a plurality of overlays may be positioned over the lacing system. A sole may be coupled to the knit upper. In at least one example, the lacing system may comprise a plurality of strap cord sections, each strap cord section of the plurality of strap cord sections positioned over a corresponding knit strap of the plurality of knit straps. Moreover, a portion of each strap cord section of the plurality of strap cord sections may be covered by a corresponding strap overlay of the plurality of overlays, where an end of each strap cord section adjacent a medial knit portion may not covered by the corresponding strap overlay. In such examples, the end of each strap cord section adjacent the medial knit portion that may not be covered by the corresponding strap overlay is approximately 20% of a length of the strap cord section. Additionally, each of the plurality of strap overlays may comprise one or more strap cord exposing openings, in at least one example. The example footwear article may further comprise a removable footbed positioned on top of the sole, the removable footbed coupled to the top of the sole via loop and hook attachment regions of the footbed and the top of the sole.

In another example footwear article, which may include any one or combination of the previous examples, the footwear article may comprise a knit upper comprising a knit medial portion, a plurality of knit straps extending from the medial portion, and a knit heel strap. Additionally, the example footwear article may further comprise a lacing cord structure including a medial cord section that is positioned over the knit medial portion, a strap cord section that is positioned over each of the plurality of knit straps, and a heel cord section that is positioned over the knit heel strap and a plurality of cord trapping overlays positioned over the lacing cord structure. A sole may further be coupled to the knit upper, and a removable footbed coupled to a top of the sole, the removable footbed forming a portion of an exterior of the footwear article, in at least one example.

In one or more examples, the knit upper may further include a knit heel strap, and where a heel opening is formed between the knit heel strap and a top of the removable footbed. Additionally, wherein a heel cord section of the lacing structure is coupled to the knit heel strap, the heel cord section may interlock with the medial cord section of the lacing structure. Further, in at least one example, each of the plurality of strap cord loops may interlock with the medial cord section. In at least one example footwear article, which may include any one or combination of the above features, wherein the plurality of cord trapping overlays may comprise a plastic material. Moreover, in at least one example, the removable footbed may comprise a water resistant material.

It will be appreciated that the configurations and/or approaches described herein are exemplary in nature, and that these specific embodiments or examples are not to be considered in a limiting sense, because numerous variations are possible. The subject matter of the present disclosure includes all novel and nonobvious combinations and subcombinations of the various features, functions, acts, and/or properties disclosed herein, as well as any and all equivalents thereof.

The invention claimed is:

1. A footwear article, comprising:

a single-piece knit upper including a knit medial portion and a plurality of knit straps extending from the knit medial portion;

a medial cord section positioned on top of the knit medial portion;

a plurality of strap cord sections, each of the plurality of strap cord sections positioned on top of a corresponding knit strap of the plurality of knit straps, where each of the strap cord sections forms a loop that interlocks with the medial cord section; and a sole coupled to the knit upper.

2. The footwear article of claim 1, further comprising a plurality of strap overlays, where each of the plurality of strap overlays is positioned over a corresponding strap cord section of the plurality of strap cord sections.

3. The footwear article of claim 2, wherein each of the plurality of strap overlays covers approximately 80% of a length of the corresponding strap cord section.

4. The footwear article of claim 2, wherein each of the plurality of strap overlays includes one or more openings formed therein.

5. The footwear article of claim 1, where the single-piece knit upper further includes a knit heel strap.

6. The footwear article of claim 5, further comprising a heel cord section positioned over the knit heel strap and a heel strap overlay positioned over the heel cord section.

7. The footwear article of claim 1, further comprising a removable footbed coupled to a top of the sole, the removable footbed forming a portion of an exterior of the footwear article.

8. A footwear article, comprising:

a knit upper, the knit upper including a knit medial portion, and a plurality of knit straps extending from the knit medial portion, where the plurality of knit straps are adjacent to one another, and where an opening defined by an edge of the knit upper is formed between each pair of adjacent straps;

an edge piping fixed to the edge of the knit upper defining the opening formed between each pair of adjacent straps;

a lacing system positioned over the knit upper;

a plurality of overlays positioned over the lacing system; and a sole coupled to the knit upper.

9. The footwear article of claim 8, wherein the lacing system comprises a plurality of strap cord sections, each strap cord section of the plurality of strap cord sections positioned over a corresponding knit strap of the plurality of knit straps.

10. The footwear article of claim 9, wherein a portion of each strap cord section of the plurality of strap cord sections is covered by a corresponding strap overlay of the plurality of overlays.

11. The footwear article of claim 10, wherein each of the plurality of strap overlays comprises one or more strap cord exposing openings.

12. The footwear article of claim 10, wherein an end of each strap cord section adjacent a medial knit portion is not covered by the corresponding strap overlay.

13. The footwear article of claim 12, wherein the end of each strap cord section adjacent the medial knit portion that is not covered by the corresponding strap overlay is approximately 20% of a length of the strap cord section.

14. The footwear article of claim 8, further comprising a removable footbed positioned on top of the sole, the removable footbed coupled to the top of the sole via loop and hook attachment regions of the footbed and the top of the sole.

15. A footwear article, comprising:

a knit upper comprising a knit medial portion, a plurality of knit straps extending from the medial portion, and a knit heel strap;

a lacing cord structure including a medial cord section that is positioned over the knit medial portion, a strap cord section that is positioned over each of the plurality of knit straps, and a heel cord section that is positioned over the knit heel strap;

a plurality of cord trapping overlays positioned over the lacing cord structure;

a sole coupled to the knit upper; and a removable footbed coupled to a top of the sole, the removable footbed forming a portion of an exterior of the footwear article.

16. The footwear article of claim 15, wherein the knit upper further includes a knit heel strap, and where a heel opening is formed between the knit heel strap and a top of the removable footbed.

17. The footwear article of claim 16, wherein a heel cord section of the lacing structure is coupled to the knit heel strap, the heel cord section interlocking with the medial cord section of the lacing structure.

18. The footwear article of claim 17, wherein each of the plurality of strap cord loops interlocks with the medial cord section.

19. The footwear article of claim 15, wherein the plurality of cord trapping overlays comprise a plastic material.

20. The footwear article of claim 15, wherein the removable footbed comprises a water resistant material.

* * * * *